US009752265B2

(12) United States Patent
Bae et al.

(10) Patent No.: US 9,752,265 B2
(45) Date of Patent: Sep. 5, 2017

(54) LAUNDRY TREATING APPARATUS

(71) Applicant: LG Electronics Inc., Seoul (KR)

(72) Inventors: Jinwoo Bae, Seoul (KR); Kyungmun Jung, Seoul (KR); Hongjun Cho, Seoul (KR); Sanghun Bae, Seoul (KR); Taegyu Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 662 days.

(21) Appl. No.: 14/192,366

(22) Filed: Feb. 27, 2014

(65) Prior Publication Data

US 2014/0238087 A1 Aug. 28, 2014

(30) Foreign Application Priority Data

Feb. 28, 2013 (KR) ..... 10-2013-0021850
Mar. 19, 2013 (KR) ..... 10-2013-0029237

(51) Int. Cl.

| | |
|---|---|
| ***D06F 31/00*** | (2006.01) |
| ***D06F 29/00*** | (2006.01) |
| *D06F 39/12* | (2006.01) |
| *D06F 25/00* | (2006.01) |

(52) U.S. Cl.

CPC ..... *D06F 31/00* (2013.01); *D06F 29/005* (2013.01); *D06F 25/00* (2013.01); *D06F 39/125* (2013.01)

(58) Field of Classification Search

CPC ..... D06F 31/00; D06F 29/005; D06F 58/10
See application file for complete search history.

(56) References Cited

U.S. PATENT DOCUMENTS

| | | | | |
|---|---|---|---|---|
| 7,866,057 | B2 | 1/2011 | Grunert et al. | |
| 8,307,567 | B2 * | 11/2012 | Han | D06F 29/005 34/132 |
| 2010/0005681 | A1 * | 1/2010 | Jo | D06F 25/00 34/215 |
| 2013/0047677 | A1 | 2/2013 | Han et al. | |

FOREIGN PATENT DOCUMENTS

| | | | |
|---|---|---|---|
| CN | 101517147 | A | 8/2009 |
| CN | 101570933 | A | 11/2009 |
| CN | 102597356 | A | 7/2012 |
| CN | 102839522 | A | 12/2012 |
| DE | 102007041875 | A1 | 7/2008 |
| WO | 2008/013395 | A2 | 1/2008 |
| WO | 2008/013411 | A2 | 1/2008 |
| WO | 2008/013413 | A2 | 1/2008 |
| WO | 2011/055974 | A2 | 5/2011 |

* cited by examiner

*Primary Examiner* — David Cormier
(74) *Attorney, Agent, or Firm* — Dentons US LLP

(57) ABSTRACT

A laundry treating apparatus is disclosed. The laundry treating apparatus includes a first cabinet having a first receiving space to receive laundry, a second cabinet having a second receiving space to receive laundry, the second cabinet being separated from the first cabinet, a partition wall located at an upper part of the second receiving space to divide an interior of the second cabinet, a discharge unit to discharge air from the first receiving space and air from the second receiving space, and a supply unit including a supply duct to selectively supply air to the first receiving space and the second receiving space and a supply fan provided in the partition wall such that the supply fan is located in the second cabinet to move air from the second receiving space to the supply duct.

19 Claims, 24 Drawing Sheets

【Figure 1】
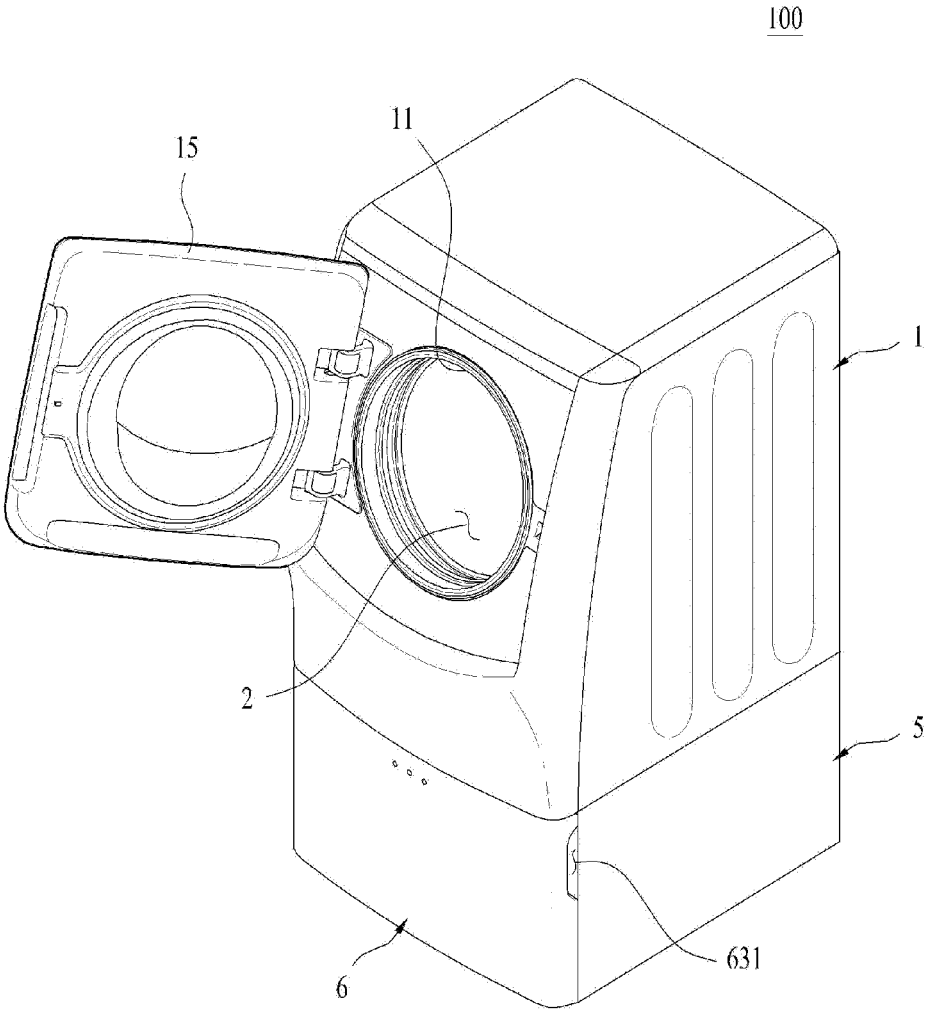

【Figure 2】
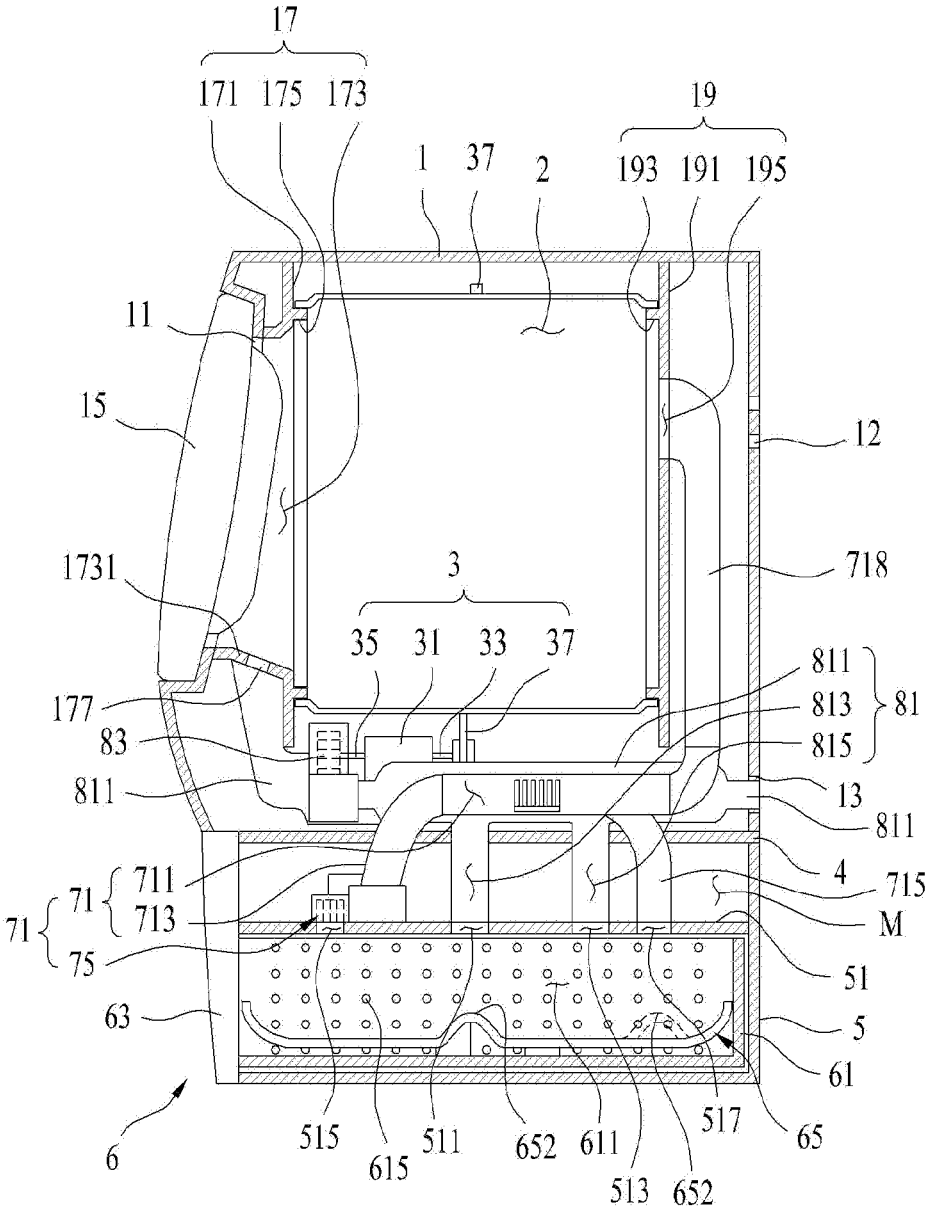

【Figure 3】
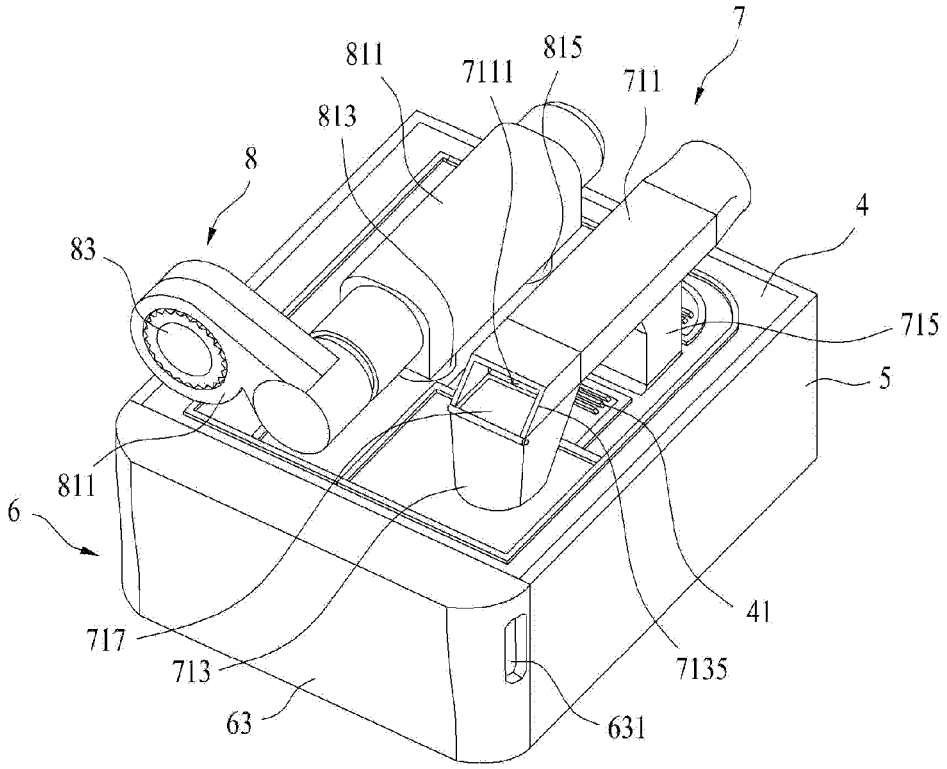
(a)
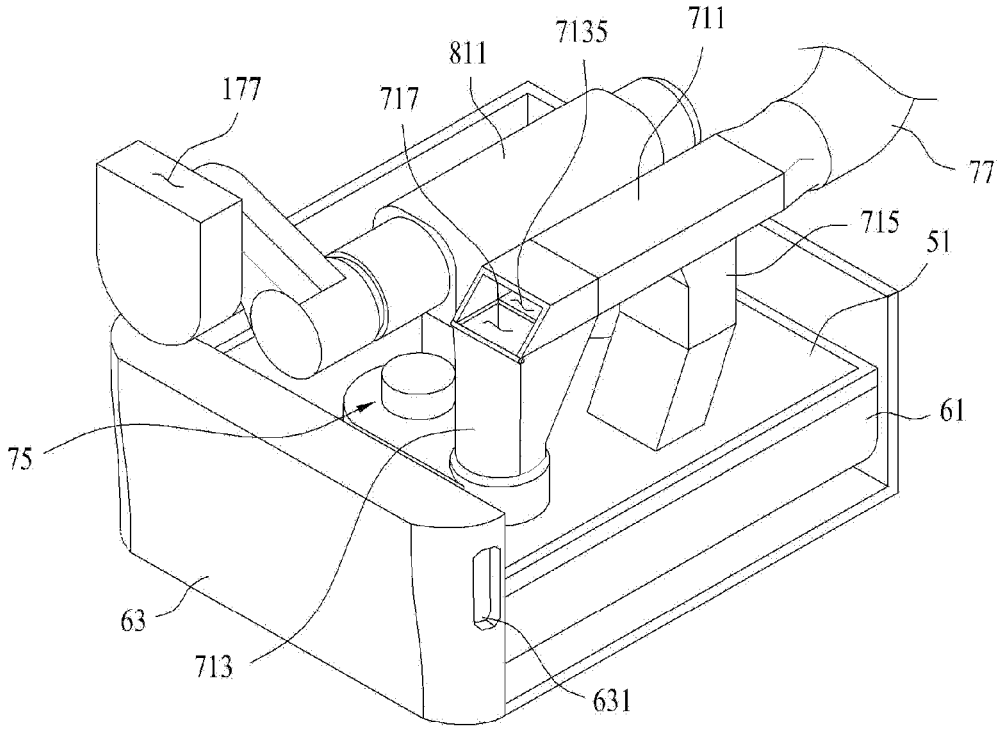
(b)

【Figure 4】
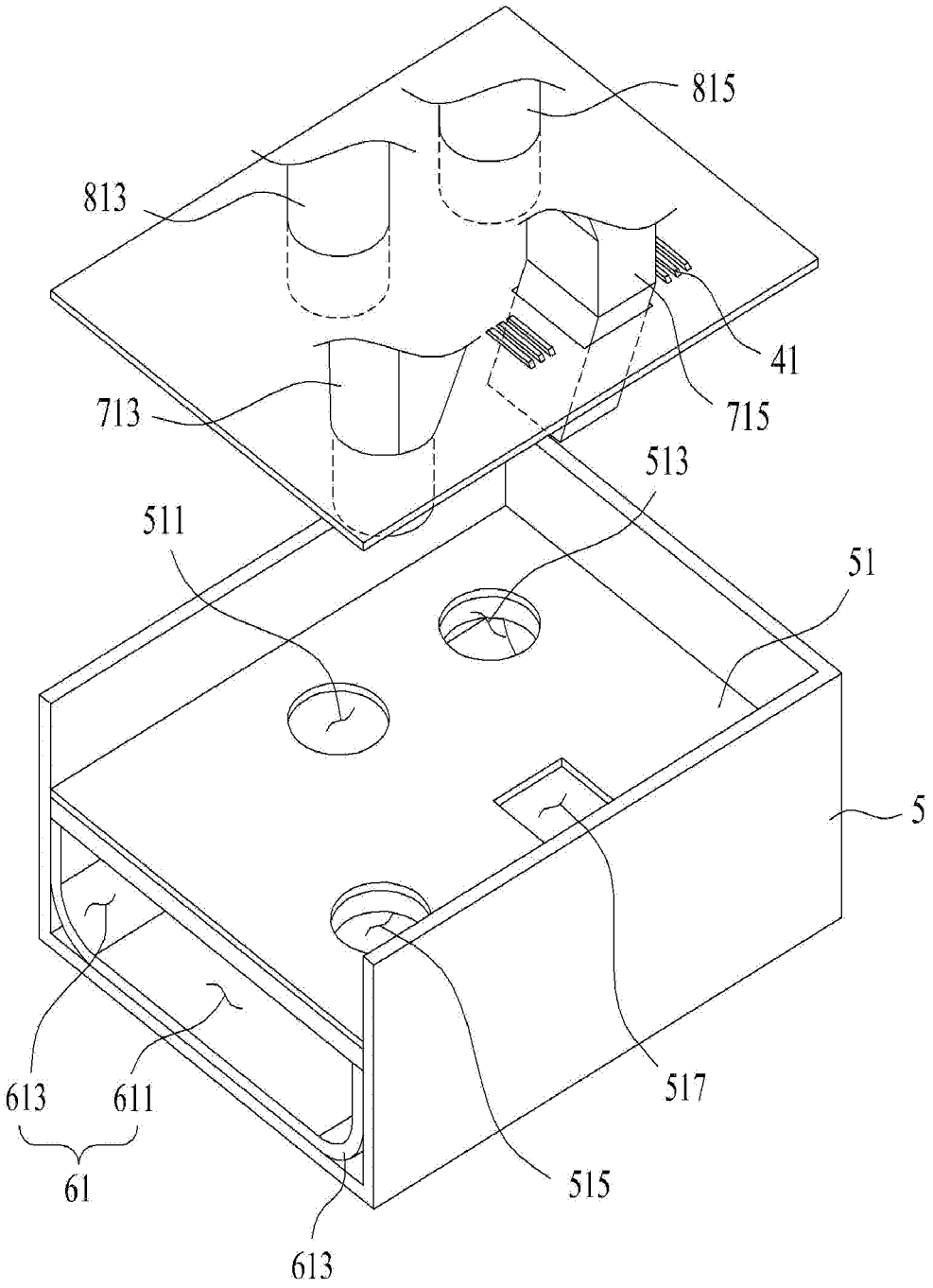

【Figure 5】
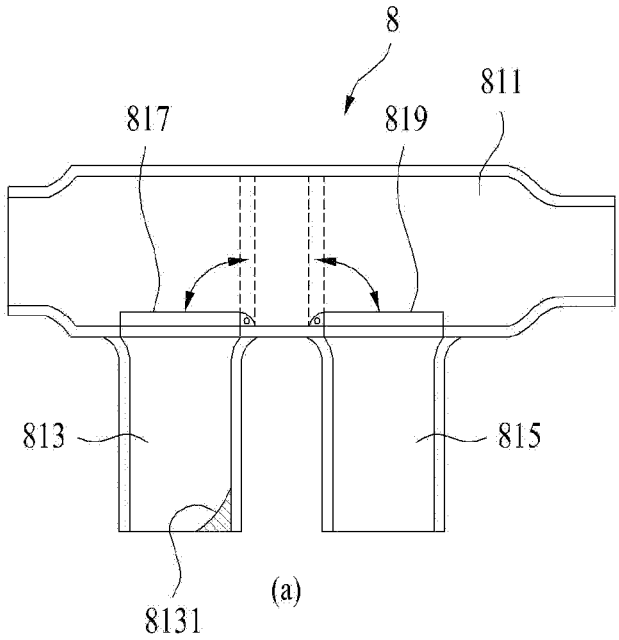
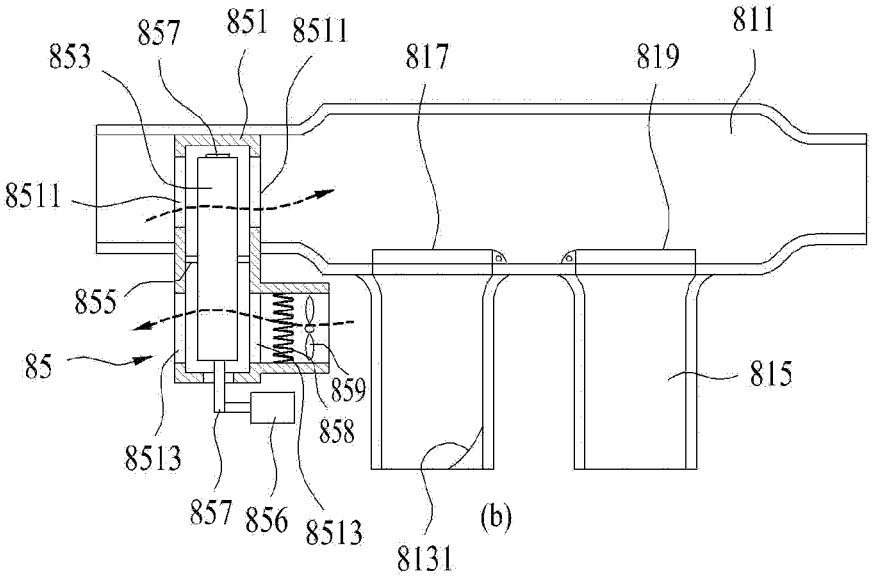

【Figure 6】
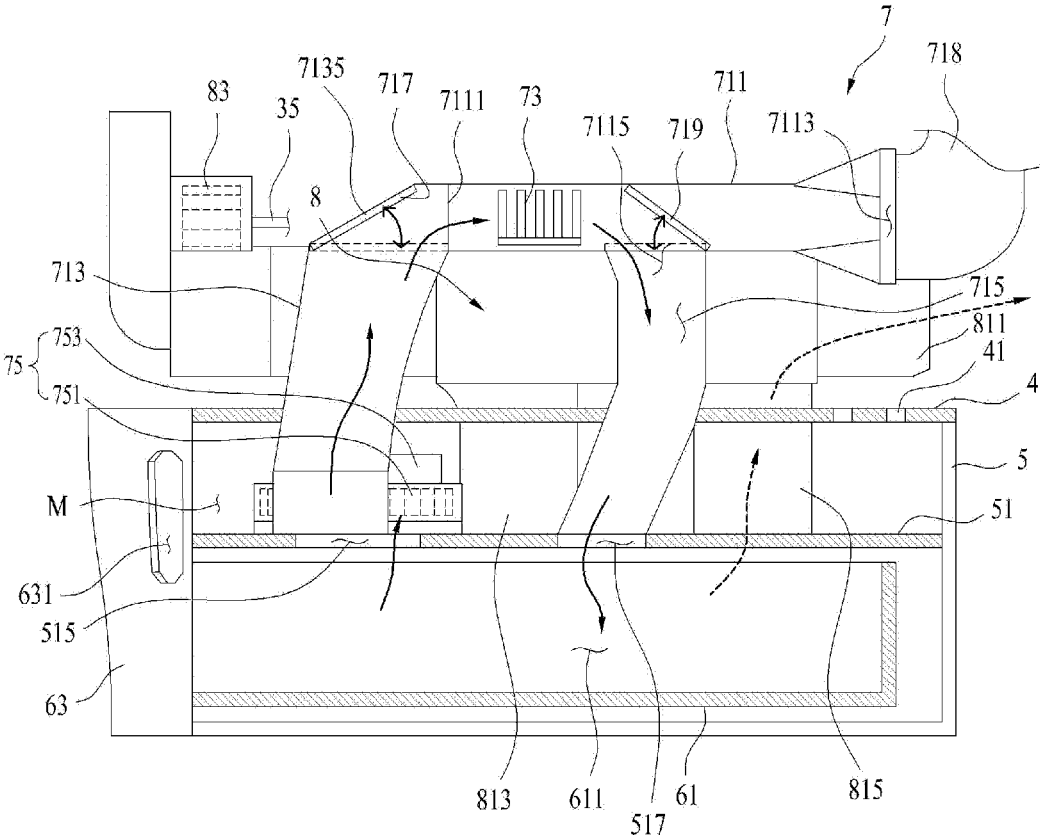

【Figure 7A】
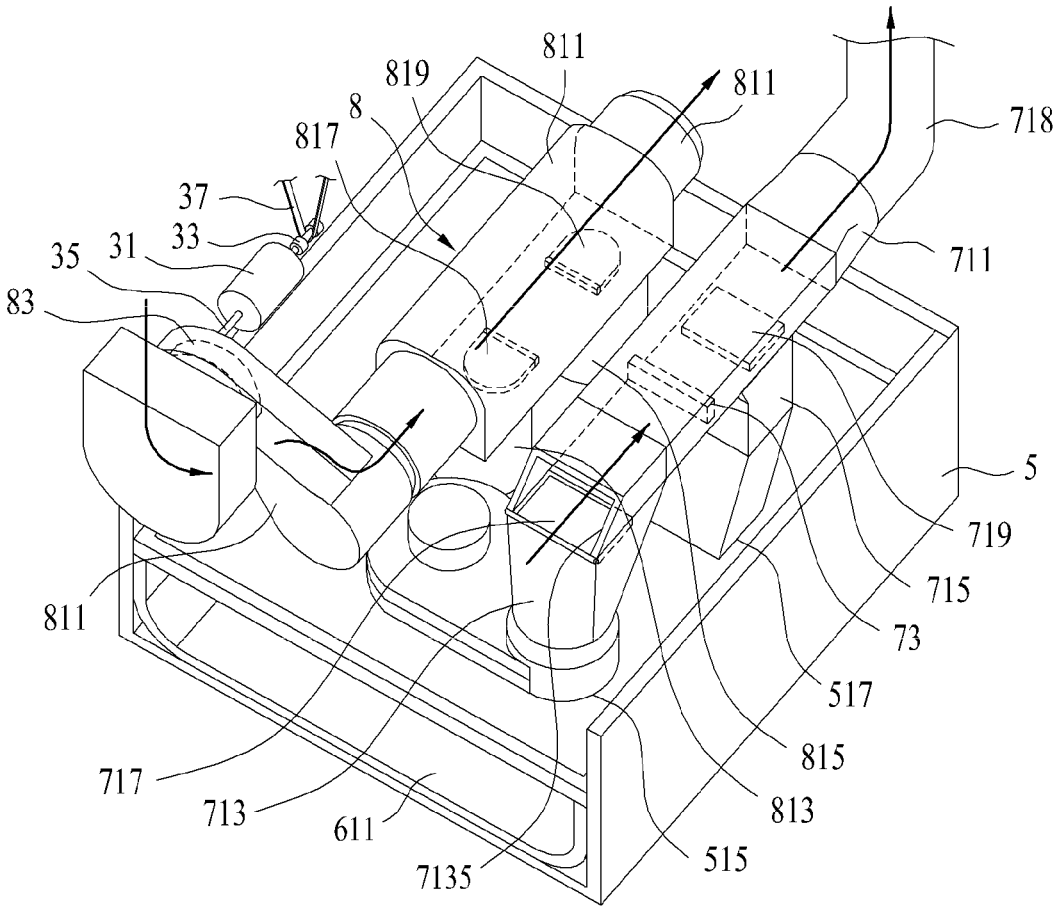

【Figure 7B】
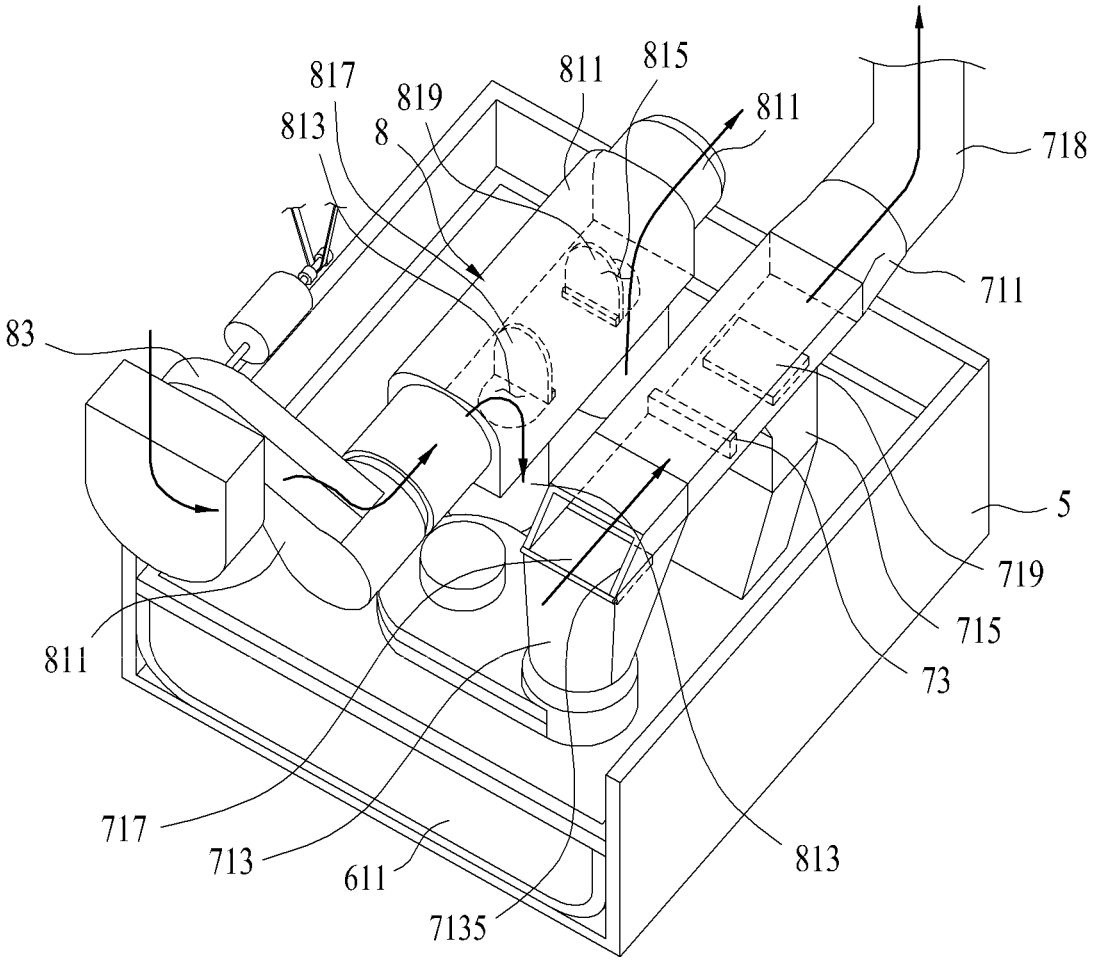

【Figure 7C】
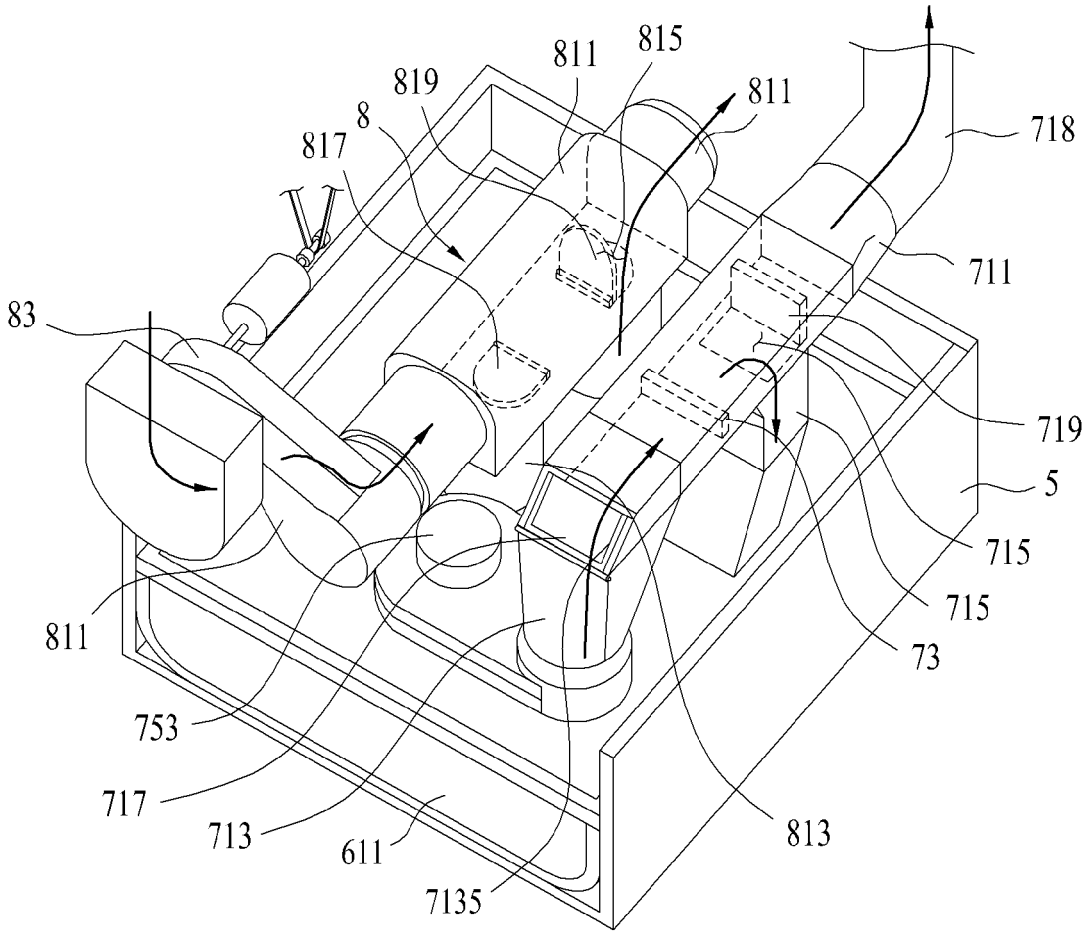

【Figure 8】
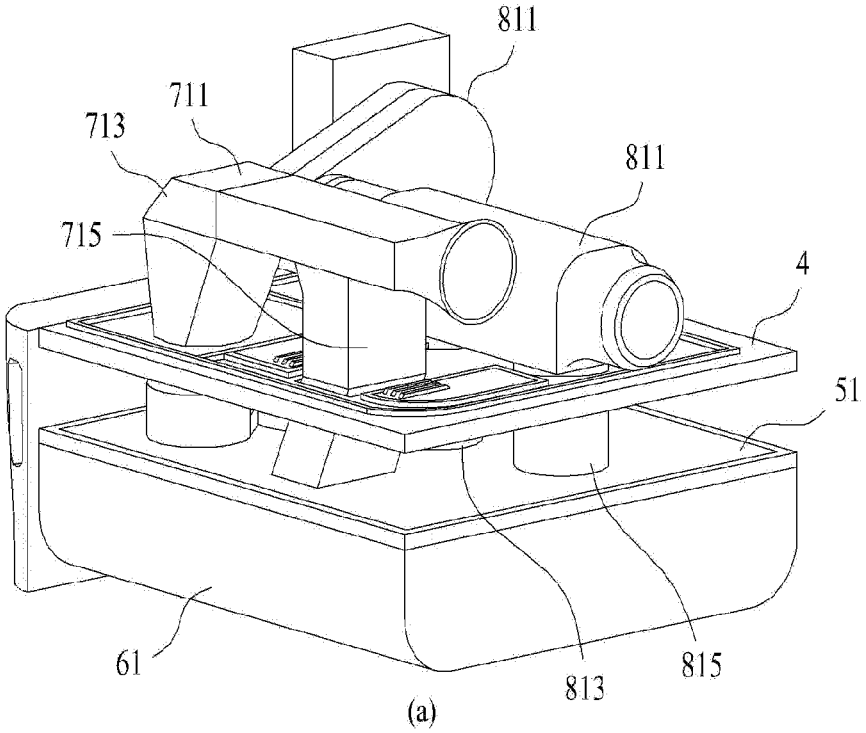
(a)
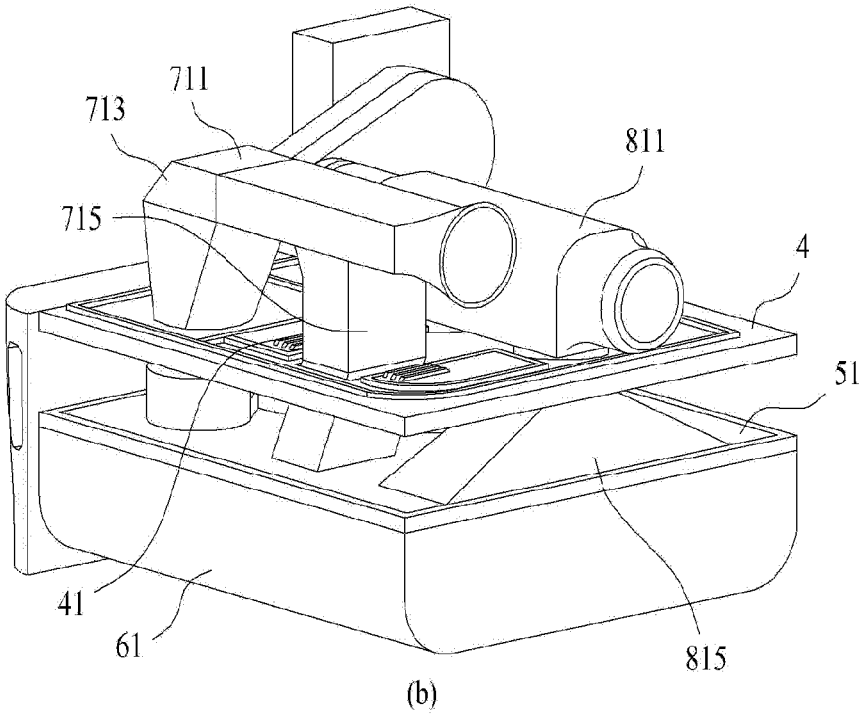
(b)

【Figure 9】
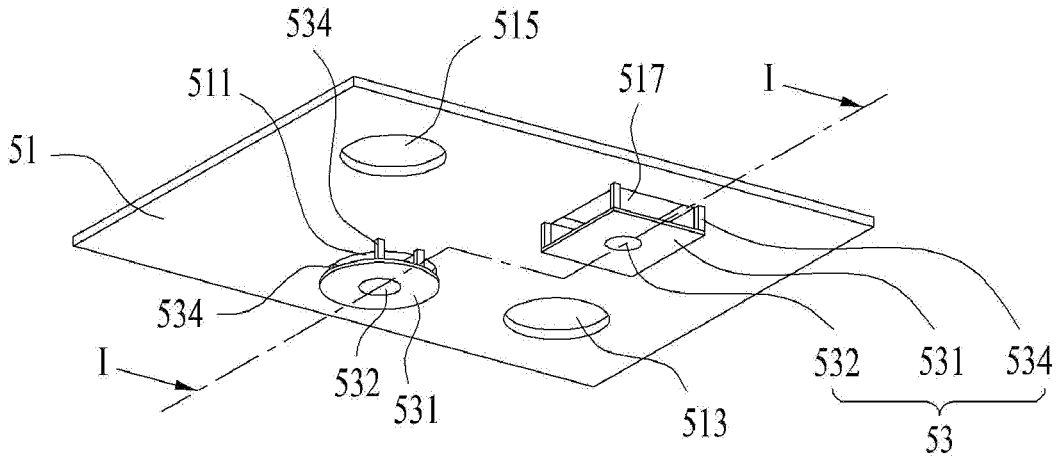
(a)
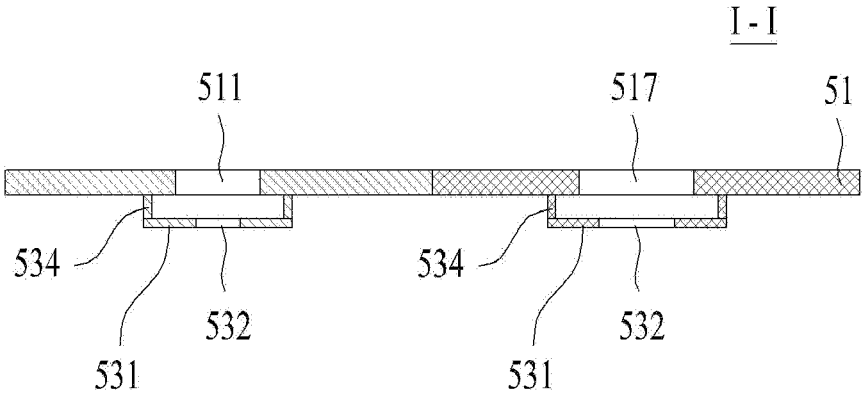
(b)

【Figure 10】
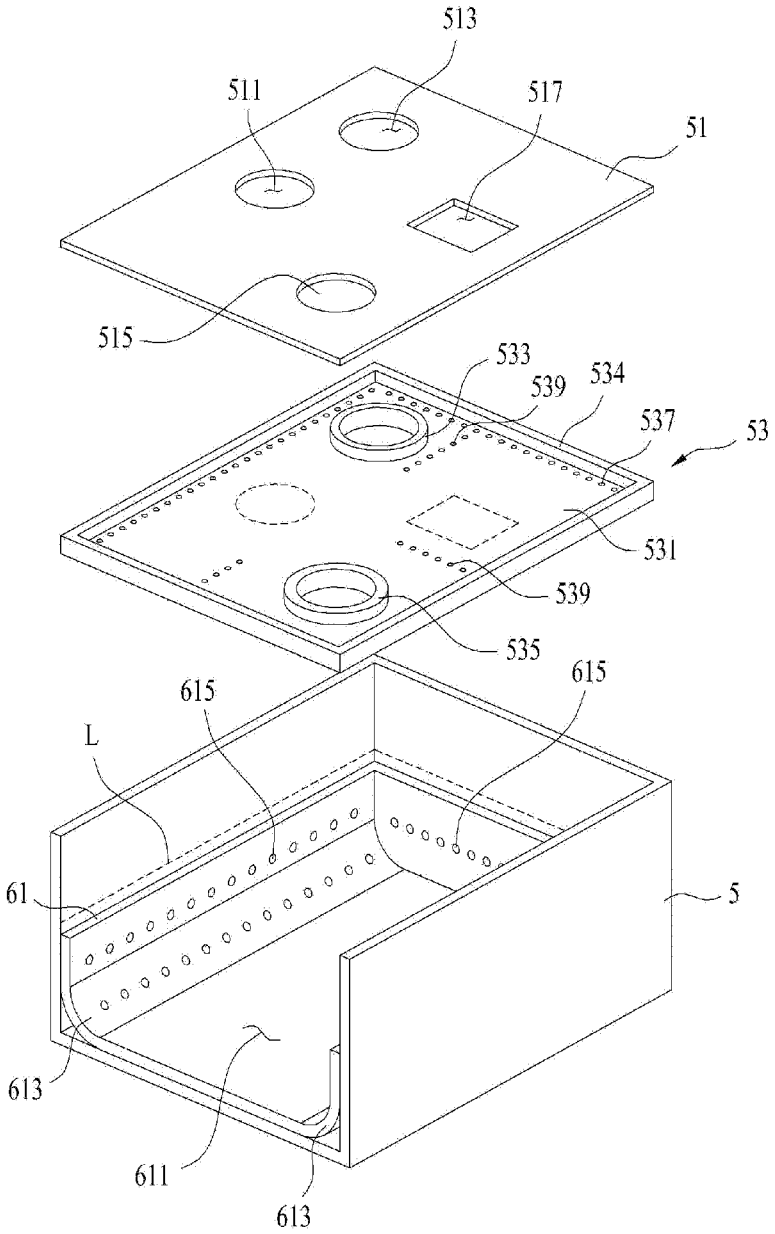

【Figure 1 1】
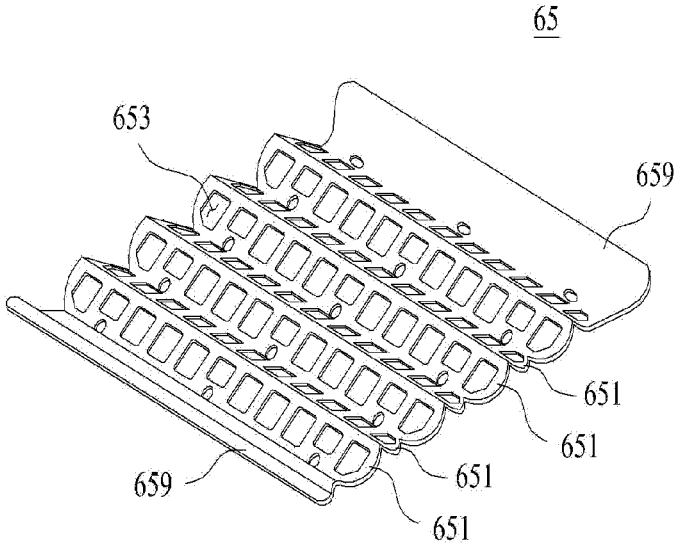
(a)
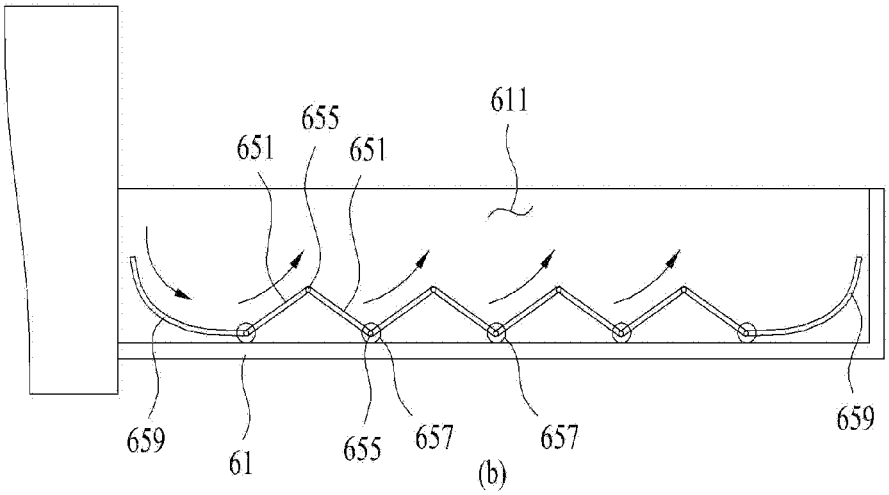
(b)

【Figure 12】
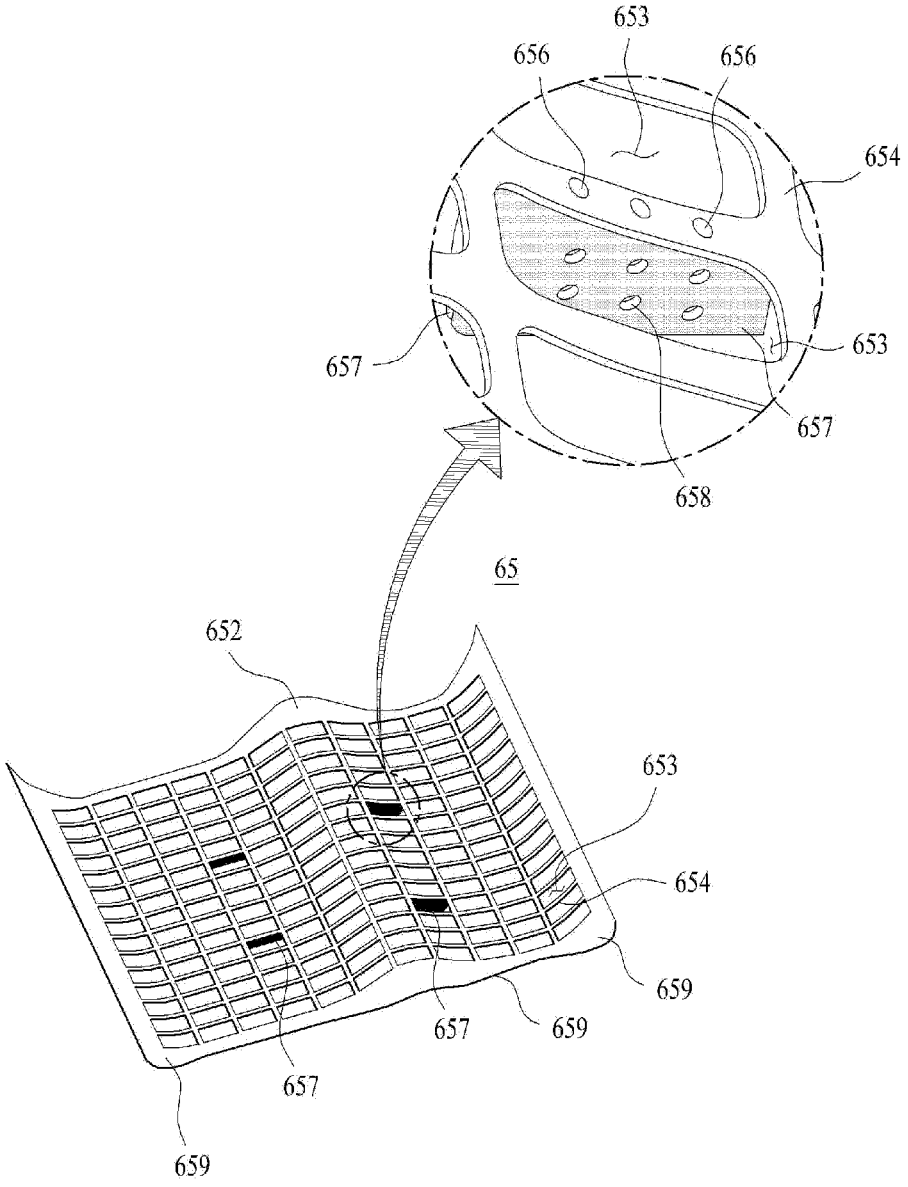

【Figure 13】
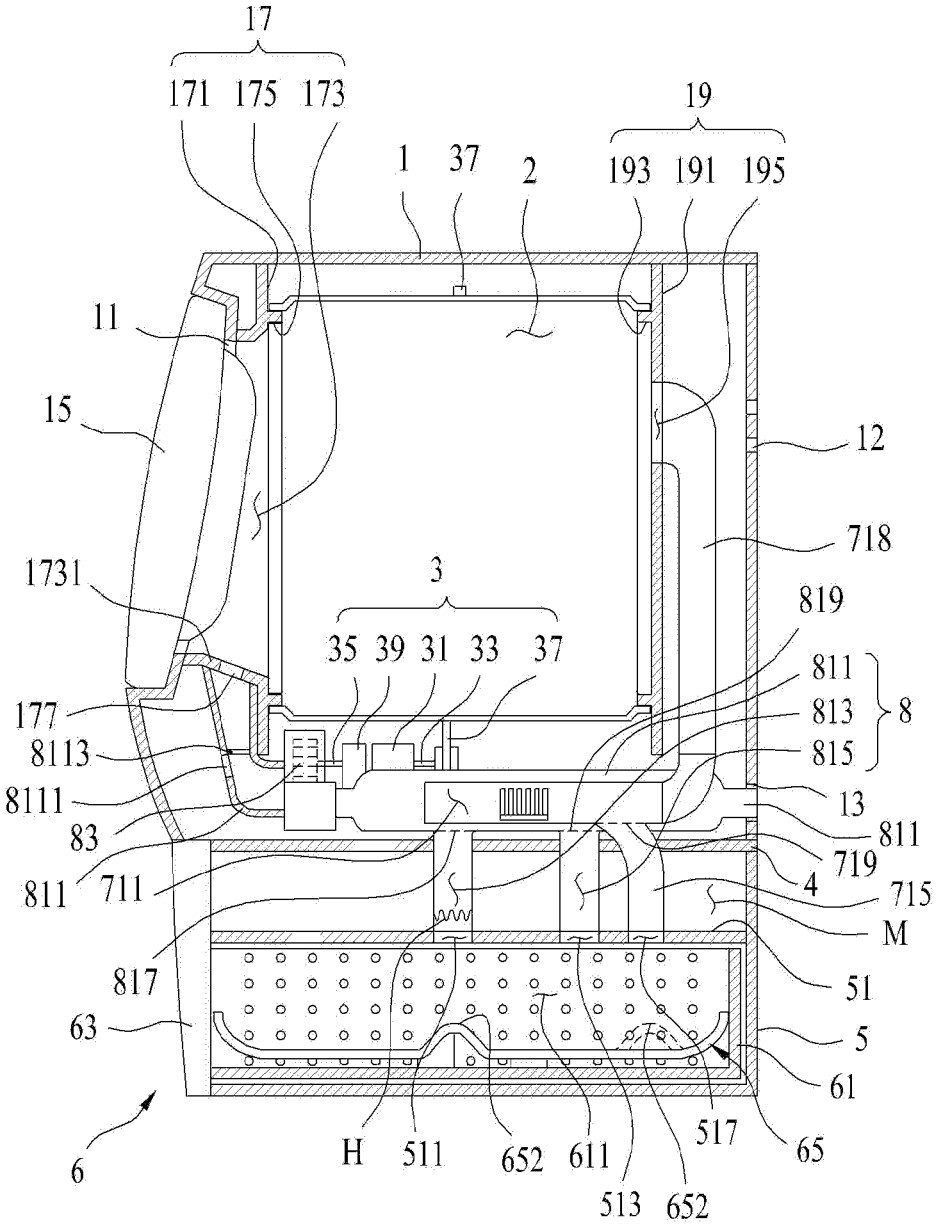

【Figure 14】
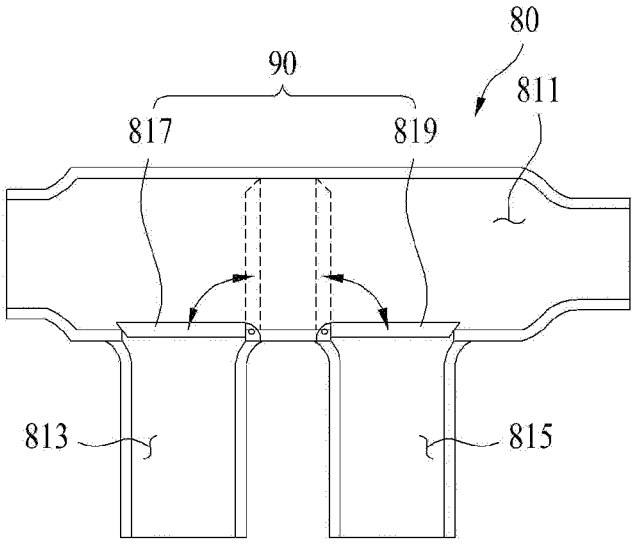
(a)
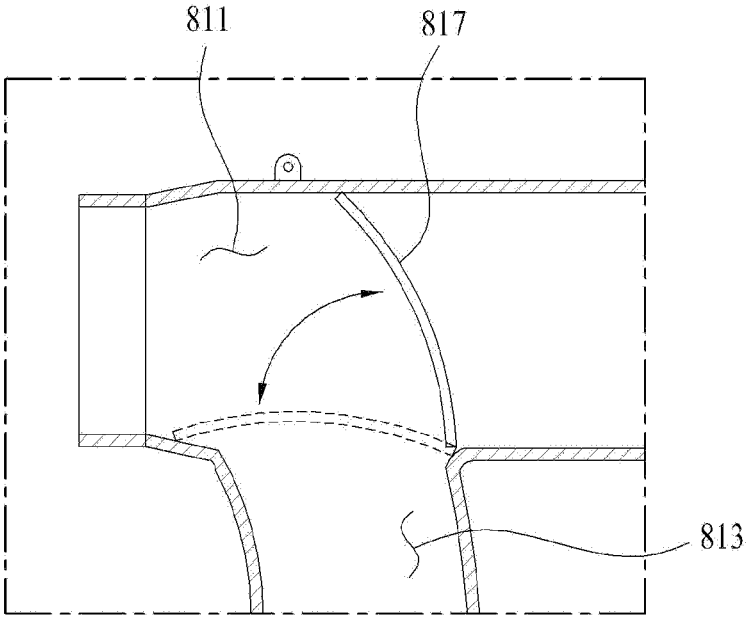
(b)

【Figure 15】
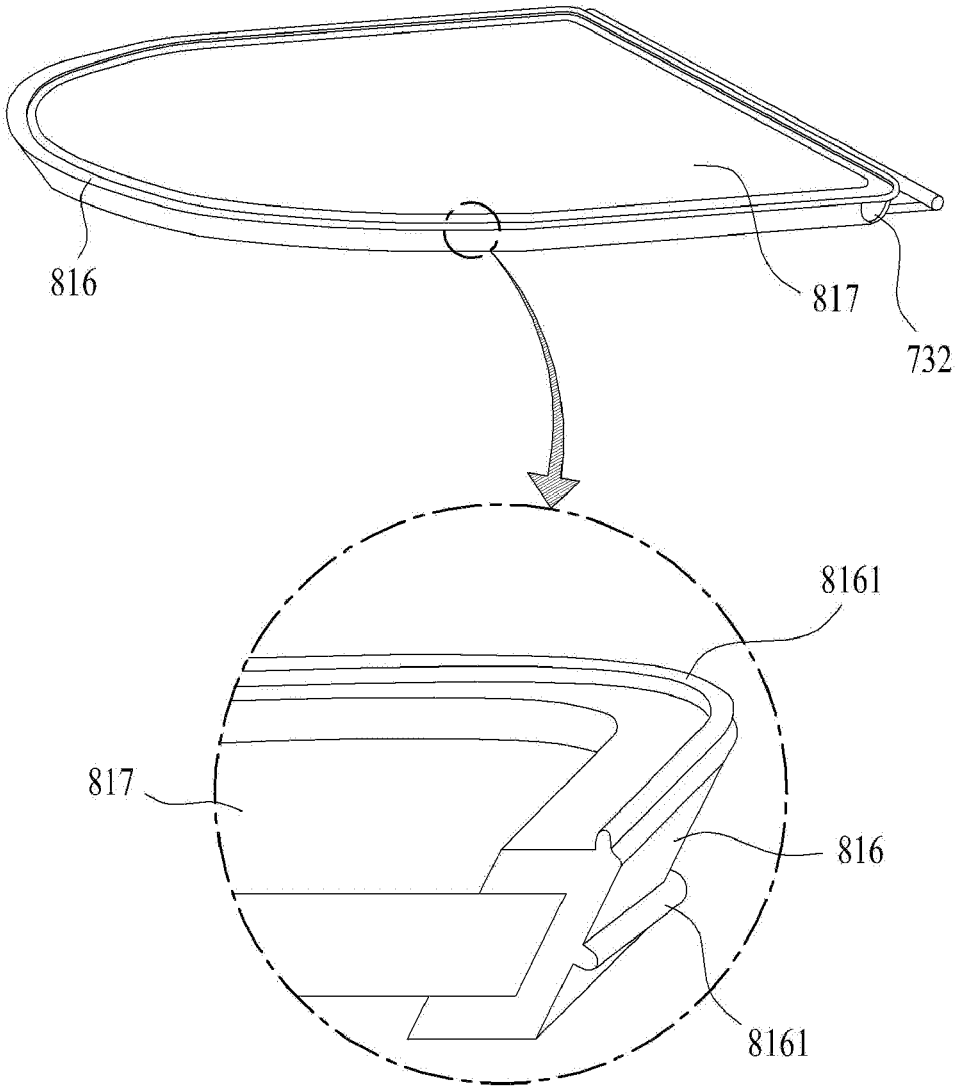

【Figure 16】
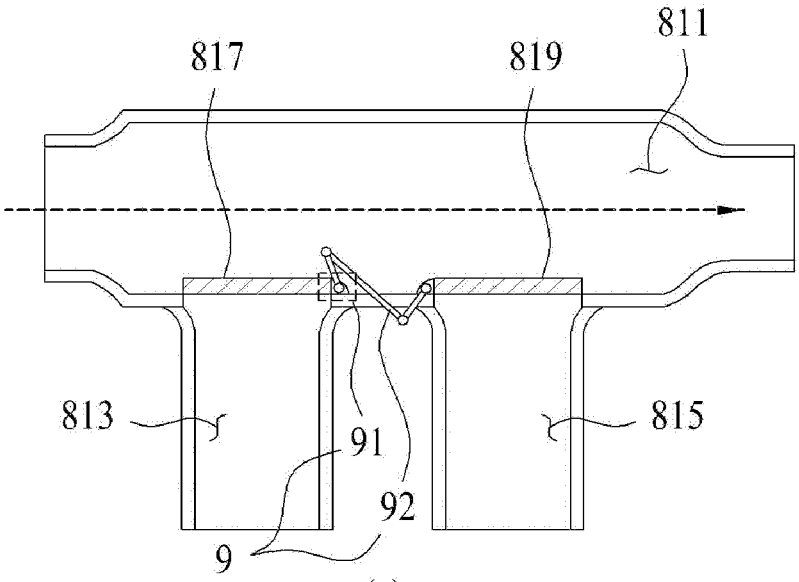
(a)
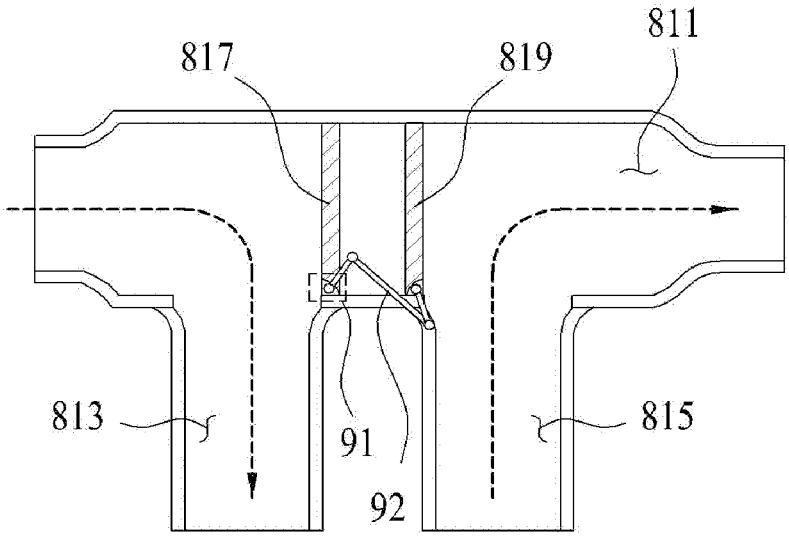
(b)

【Figure 17】
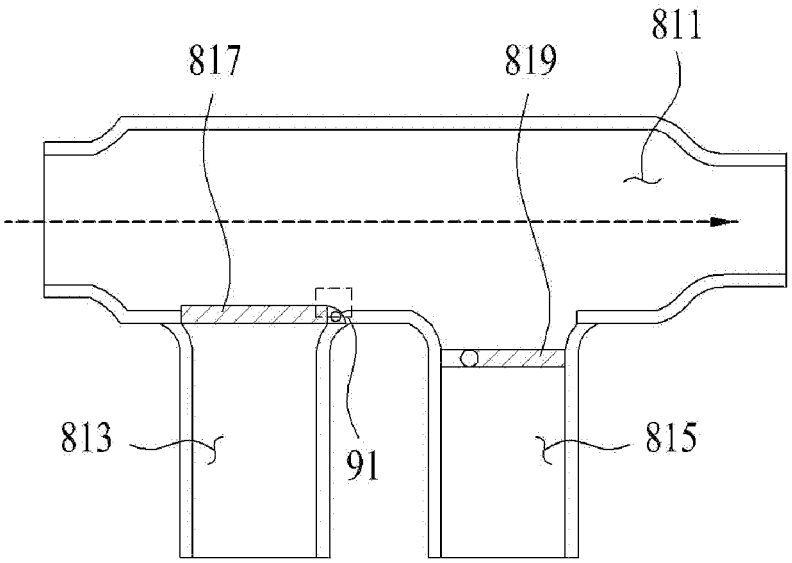
(a)
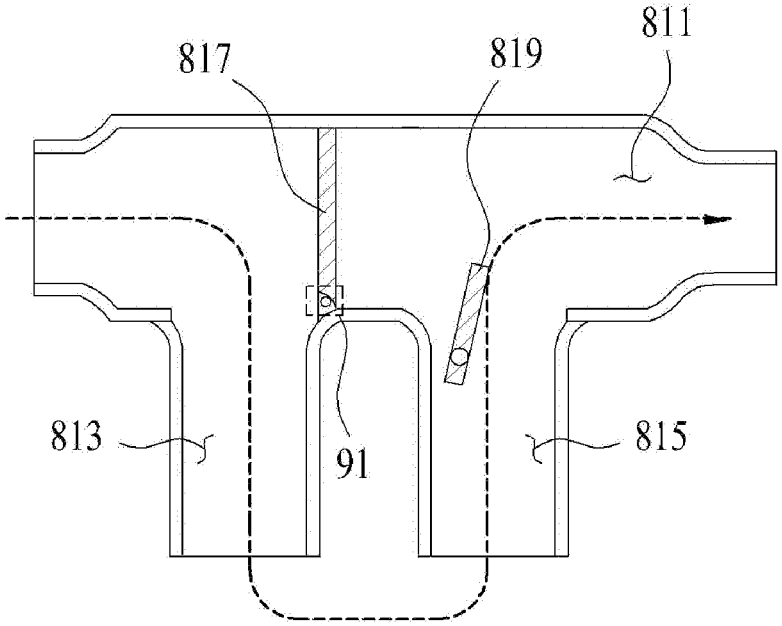
(b)

【Figure 18】
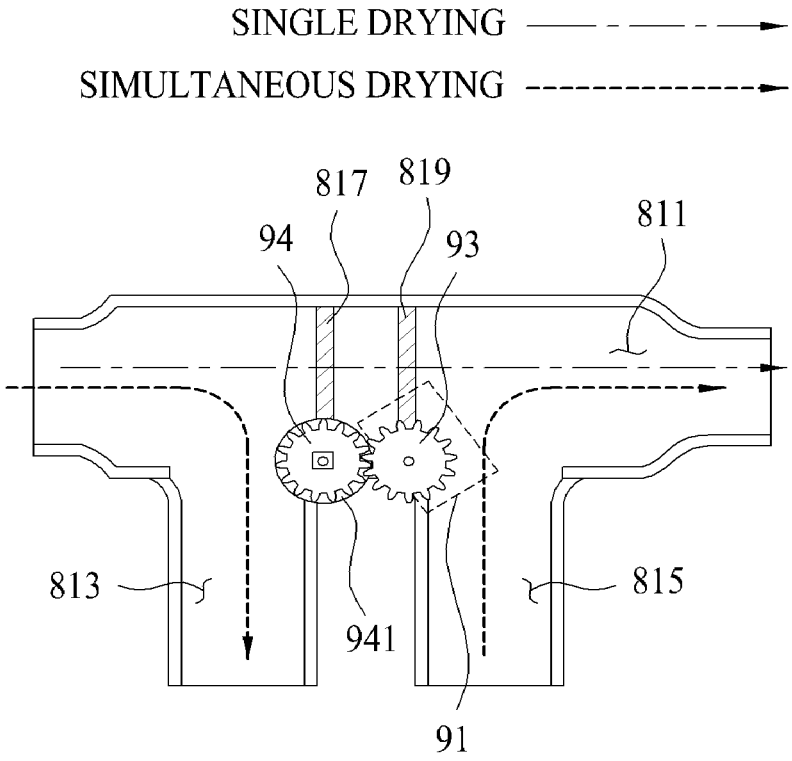
(a)
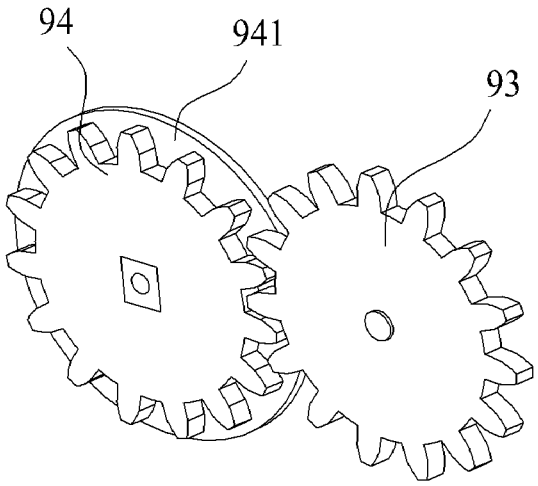
(b)

【Figure 19】
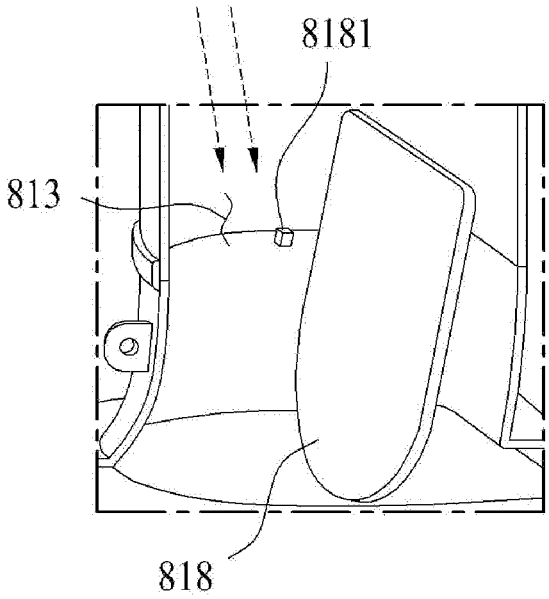
(a)
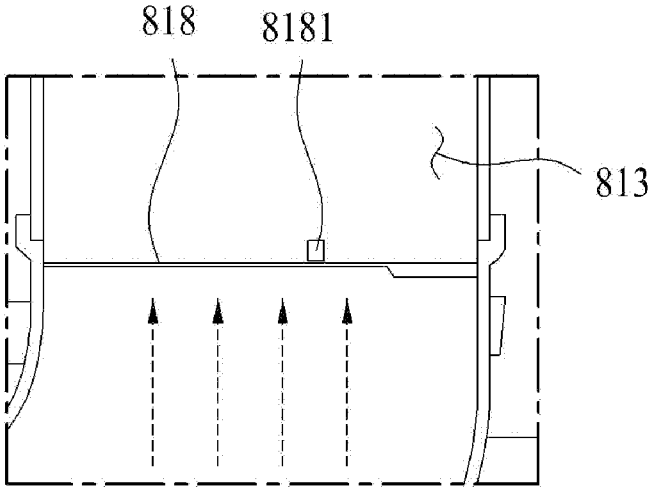
(b)

【Figure 20】
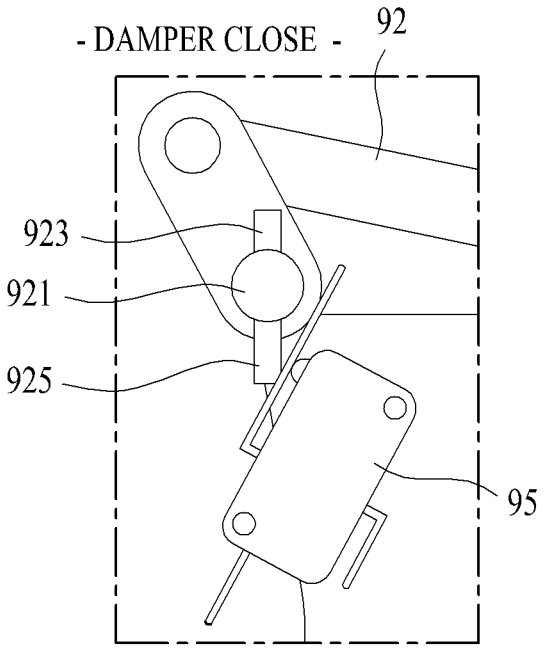
(a)
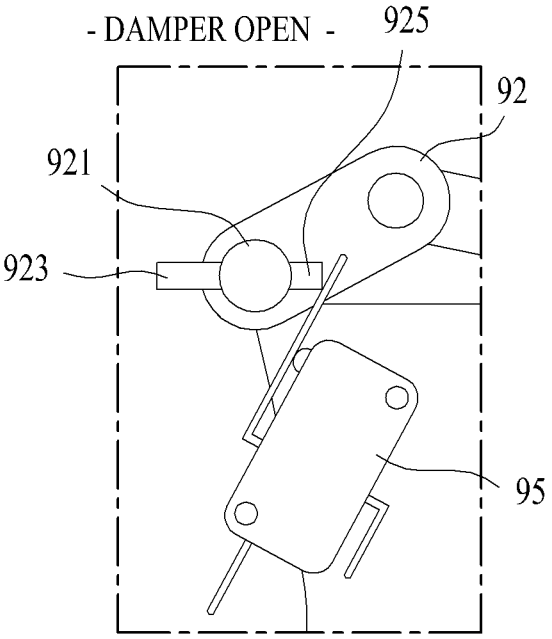
(b)

【Figure 21】
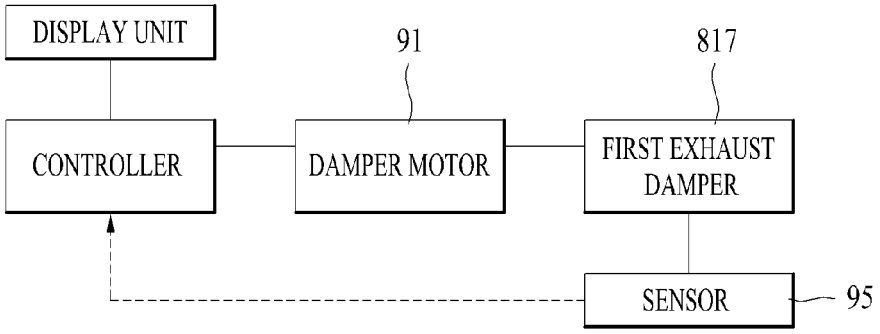

【Figure 22】
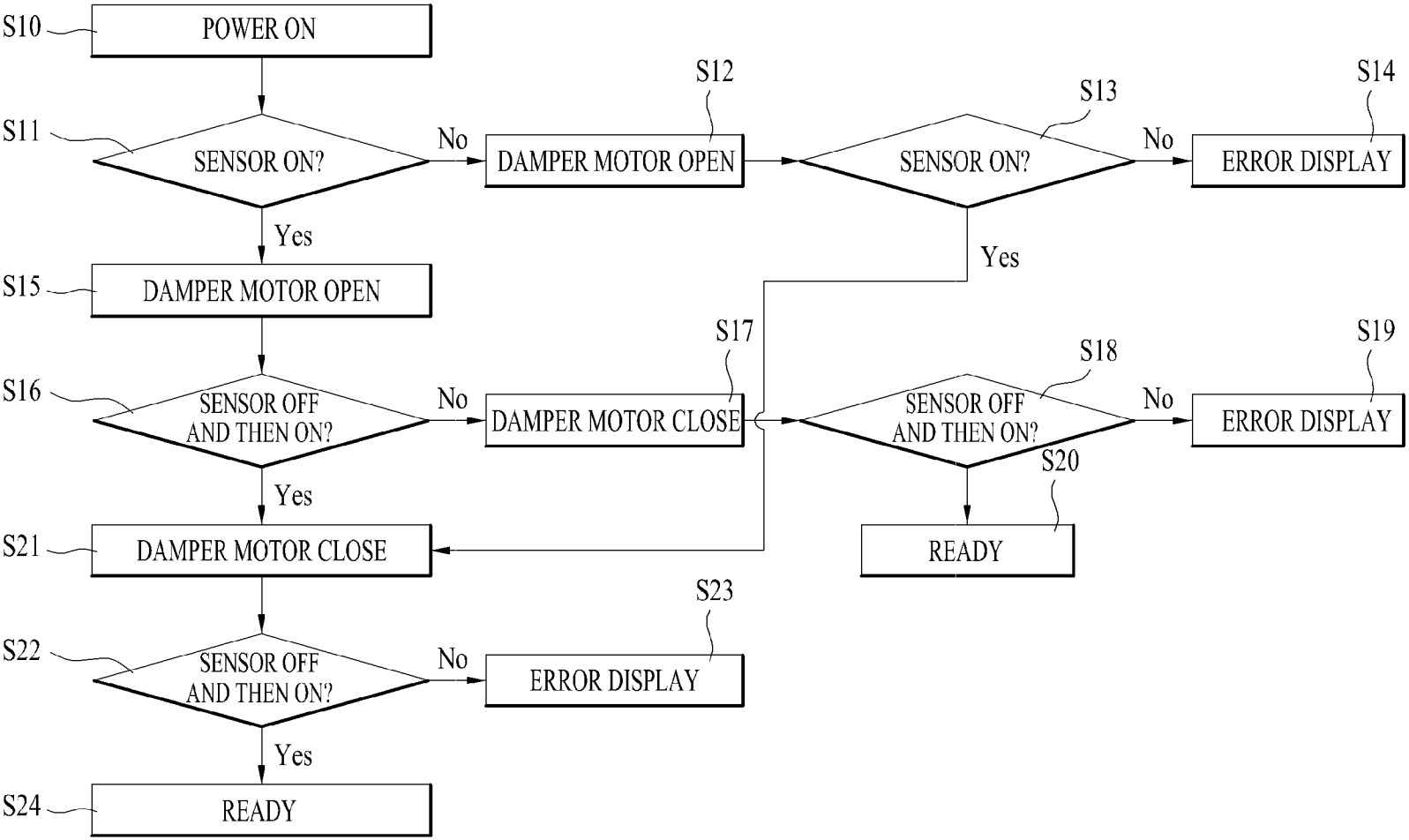

LAUNDRY TREATING APPARATUS

This application claims the benefit of Korean Patent Application No. 10-2013-0021850, filed on Feb. 28, 2013, and Korean Patent Application No. 10-2013-0029237, filed on Mar. 19, 2013, which is hereby incorporated by reference as if fully set forth herein.

BACKGROUND OF THE INVENTION

Field of the Invention

The present invention relates to a laundry treating apparatus.

Discussion of the Related Art

A laundry treating apparatus is a home appliance hat is capable of washing and/or drying laundry (clothes). The laundry treating apparatus includes a washing machine, a drying machine, and a washing and drying machine.

A laundry treating apparatus that is capable of drying laundry supplies high-temperature air (hot air) to the laundry. Based on flow mode of air, the laundry treating apparatus may be classified as an exhaust type laundry treating apparatus or a circulation type (condensation type) laundry treating apparatus.

The circulation type laundry treating apparatus is configured to have a structure in which water is removed from air discharged from a receiving space (i.e. the air is dehumidified), the dehumidified air is heated, and the heated air is resupplied into the receiving space.

The exhaust type laundry treating apparatus is configured to have a structure in which heated air is supplied to a receiving space and air discharged from the receiving space is not resupplied into the receiving space but is exhausted out of the laundry treating apparatus.

Meanwhile, in a conventional laundry treating apparatus, a space to receive laundry is divided into a first receiving space and a second receiving space such that laundry is dried using any one selected from between the first receiving space and the second receiving space based on the amount of the laundry.

Such a laundry treating apparatus includes an exhaust fan to discharge air from the first receiving space. The exhaust fan is rotated by a drive unit to rotate the first receiving space. That is, the first receiving space and the exhaust fan are simultaneously rotated during rotation of the drive unit.

Meanwhile, the laundry treating apparatus as described above is configured such that air in the first receiving space passes through the second receiving space and is then discharged out of the laundry treating apparatus to supply air to both the first receiving space and the second receiving space. However, the laundry treating apparatus has the following problems.

Since the first receiving space and the exhaust fan are rotated by one drive unit, the first receiving space, in which laundry is not placed, may be rotated even when air is supplied only to the second receiving space with the result that a user may think that the laundry treating apparatus may malfunction.

In addition, when only laundry stored in the second receiving space is dried, hot air is introduced into the second receiving space through the first receiving space with the result that drying efficiency is reduced (drying time is increased and temperature of hot air is decreased).

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that supplies air to a plurality of receiving spaces provided to dry laundry.

Another object of the present invention is to provide a laundry treating apparatus that is capable of simultaneously supply air to a plurality of receiving spaces in which laundry is received and selectively supplying air only to a specific one of the receiving spaces.

Another object of the present invention is to provide a laundry treating apparatus configured such that air blowing means to supply air to a plurality of receiving spaces are individually provided in the respective receiving spaces.

A further object of the present invention is to provide a laundry treating apparatus with high drying efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a first cabinet having a first receiving space to receive laundry, a second cabinet having a second receiving space to receive laundry, the second cabinet being separated from the first cabinet, a partition wall located at an upper part of the second receiving space to divide an interior of the second cabinet, a discharge unit to discharge air from the first receiving space and air from the second receiving space, and a supply unit including a supply duct to selectively supply air to the first receiving space and the second receiving space and a supply fan provided in the partition wall such that the supply fan is located in the second cabinet to move air from the second receiving space to the supply duct.

The supply duct may include a heating channel provided in the first cabinet to heat air, the heating channel having a first discharge port and a second discharge port to discharge the heated air, a first supply channel connected between the first discharge port and the first receiving space, a second supply channel to allow the second discharge port and the second receiving space to communicate with each other therethrough, and an exhaust channel connected between the second receiving space and the heating channel, the supply fan being provided in the exhaust channel.

The supply duct may further include a suction port provided at the exhaust channel to introduce air from the first cabinet to the heating channel, a first supply damper to selectively open and close the suction port and the exhaust channel, and a second supply damper to selectively open and close the first discharge port and the second discharge port.

The discharge unit may include a duct body provided in the first cabinet to allow the first receiving space to communicate with an outside of the first cabinet therethrough, a first connection channel connected between the duct body and the second receiving space to guide air from the duct body to the second receiving space, and a second connection channel connected between the duct body and the second receiving space to guide air from the second receiving space to the duct body.

The discharge unit may further include a first exhaust damper to selectively open any one selected from between the first connection channel and the duct body and a second exhaust damper to selectively open any one selected from between the second connection channel and the duct body.

The discharge unit may further include an exhaust fan provided in the duct body such that the exhaust fan is located between the first receiving space and the first connection channel to move air from the first receiving space to the duct body.

The discharge unit may further include a dehumidification unit located between the exhaust fan and the first connection channel to dehumidify air discharged from the first receiving space.

The laundry treating apparatus may further include a drive unit having a first rotary shaft to rotate the first receiving space and a second rotary shaft to rotate the exhaust fan.

The partition wall may include a first connection channel fixing hole to allow the first connection channel to communicate with the second receiving space therethrough, a second connection channel fixing hole to allow the second connection channel to communicate with the second receiving space therethrough, an exhaust channel fixing hole to allow the exhaust channel to communicate with the second receiving space therethrough, and a supply channel fixing hole to allow the second supply channel to communicate with the second receiving space therethrough.

The laundry treating apparatus may further include a diffusion unit provided below the partition wall to diffuse air introduced into the second receiving space through at least one selected from between the first connection channel and the second supply channel in the second receiving space.

The diffusion unit may include a diffusion plate provided below the supply channel fixing hole and a plurality of spacers provided along an outer circumference of the diffusion plate at intervals such that the diffusion plate is spaced apart from the supply channel fixing hole by a predetermined distance.

The diffusion unit may include a diffusion plate provided below the first connection channel fixing hole and a plurality of spacers provided along an outer circumference of the diffusion plate at intervals such that the diffusion plate is spaced apart from the first connection channel fixing hole by a predetermined distance.

The diffusion unit may include a diffusion plate provided below the partition wall, a spacer provided to surround the first connection channel fixing hole, the second connection channel fixing hole, the exhaust channel fixing hole, and the supply channel fixing hole such that the diffusion plate is spaced apart from the partition wall by a predetermined distance, an exhaust channel connection pipe formed through the diffusion plate such that the exhaust channel connection pipe is connected to the exhaust channel fixing hole, a connection channel connection pipe formed through the diffusion plate such that the connection channel connection pipe is connected to the second connection channel fixing hole, and a plurality of supply holes formed through the diffusion plate.

The supply holes may include at least one selected from between a plurality of first supply holes provided along an edge of the diffusion plate and a plurality of second supply holes arranged from the edge of the diffusion plate toward a middle of the diffusion plate.

The second cabinet may be provided below the first cabinet to support the first cabinet and the second receiving space may include a drawer configured to be drawn from the second cabinet.

The drawer may be provided with a rack to space laundry from a bottom of the drawer by a predetermined distance.

The rack may include a rack body provided in the drawer, a protruding part protruding from the rack body toward at least one selected from between the second connection channel fixing hole and the supply channel fixing hole, a plurality of rack body through holes formed through the rack body, and a body support part provided at the rack body to space the rack body from a bottom of the drawer by a predetermined distance.

The rack may further include a rib to divide the rack body through holes from each other, a rib through hole formed through the rib such that an upper side of the rack body communicates with a lower side of the rack body through the rib through hole, and a support part through hole formed through the body support part.

The rack may further include a rack inclined part provided at an edge of the rack body such that the rack inclined part is at an angle to the partition wall and the drawer may further include an inclined part provided at an edge of the drawer such that the inclined part is at an angle to the partition wall, the inclined part being perpendicular to the rack inclined part.

The laundry treating apparatus may further include a damper drive unit to rotate the first exhaust damper and the second exhaust damper such that the first connection channel and the second connection channel are simultaneously opened or closed.

The damper drive unit may include a damper motor to supply driving force necessary to open and close the first exhaust damper and a power transmission unit to transmit force generated by the damper motor to the second exhaust damper.

The power transmission unit may include a four-bar link.

The power transmission unit may include a first gear coupled to the rotary shaft of the first exhaust damper and a second gear coupled to the rotary shaft of the second exhaust damper, the second gear being engaged with the first gear.

The power transmission unit may further include a first stopper provided at the second gear to prevent axial movement of the second exhaust damper during rotation of the second exhaust damper.

The damper drive unit may further include a damper motor to drive the first exhaust damper and the second exhaust damper may open or close the second connection channel based on air pressure in the second receiving space.

At least one selected from between a free end and an outer circumference of the first exhaust damper or the second exhaust damper may be inclined.

The damper drive unit may further include a sealer provided to surround a top edge and a bottom edge of the first exhaust damper or the second exhaust damper.

The sealer may be formed of a silicon material.

The sealer may include a flange protruding from the surface of the sealer.

At least one selected from between the first exhaust damper and the second exhaust damper may be curved.

The laundry treating apparatus may further include a sensor to sense positions of the first exhaust damper and the second exhaust damper.

The laundry treating apparatus may further include an auxiliary damper rotatably provided in the first connection channel and a second stopper located on a rotational course of the auxiliary damper to restrict a rotational angle of the auxiliary damper.

The thickness of a free end of the auxiliary damper may be set such that the thickness of an upper part of the free end is greater than that of a lower part of the free end during rotation of the auxiliary damper.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 1 and 2 are views showing a laundry treating apparatus according to an embodiment of the present invention;

FIG. 3 is a view showing a second cabinet, a supply unit, and a discharge unit included in the laundry treating apparatus according to the embodiment of the present invention;

FIG. 4 is a view showing a cabinet wall, a partition wall, a drawer, and the second cabinet included in the laundry treating apparatus according to the embodiment of the present invention;

FIG. 5 is a view showing the discharge unit included in the laundry treating apparatus according to the embodiment of the present invention;

FIG. 6 is a view showing the supply unit included in the laundry treating apparatus according to the embodiment of the present invention;

FIG. 7 is a view showing operation of the laundry treating apparatus according to the embodiment of the present invention;

FIG. 8 is a view showing the second cabinet, the supply unit, and the discharge unit included in the laundry treating apparatus according to the embodiment of the present invention;

FIGS. 9 and 10 are views showing a diffusion unit included in the laundry treating apparatus according to the embodiment of the present invention;

FIGS. 11 and 12 are views showing a rack included in the laundry treating apparatus according to the embodiment of the present invention;

FIG. 13 is a view showing a laundry treating apparatus according to another embodiment of the present invention;

FIG. 14 is a view showing a first exhaust damper and a second exhaust damper included in the laundry treating apparatus according to the embodiment of the present invention;

FIG. 15 is a view showing sealers provided at the outer circumferences of the first exhaust damper and the second exhaust damper;

FIG. 16 is a view showing a damper drive unit to control operation of the first exhaust damper and the second exhaust damper;

FIG. 17 is a view showing a case in which the damper drive unit includes only a damper motor;

FIG. 18 is a view showing that a power transmission unit of the damper drive unit includes a first gear and a second gear;

FIG. 19 is a view showing that an auxiliary damper to prevent wet air discharged from a drum from being introduced into the drawer is provided in a first connection channel; and FIGS. 20 to 22 are views showing a sensor to sense positions of the first exhaust damper and the second exhaust damper and a controller included in the laundry treating apparatus including the damper drive unit shown in FIGS. 16 to 18.

DETAILED DESCRIPTION OF THE INVENTION

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

As shown in FIG. 1, a laundry treating apparatus 100 according to an embodiment of the present invention includes a first cabinet 1 having a first receiving space to receive laundry (laundry to be washed or laundry to be dried) and a second cabinet 5 having a second receiving space to receive laundry, the second cabinet 5 being separated from the first cabinet 1.

As shown in FIG. 2, a laundry introduction port 11, through which laundry is introduced into and removed from the first cabinet 1, is provided at a front panel of the first cabinet 1. The laundry introduction port 11 is opened and closed by a door 15 hinged to the first cabinet 1.

Meanwhile, an outside air introduction port 12 and an discharge port 13, through which the inside of the first cabinet 1 communicates with the outside of the first cabinet 1, may be provided at a rear panel of the first cabinet 1.

The outside air introduction port 12 is a means to allow outside air to be introduced into the first cabinet 1 therethrough and the discharge port 13 is a means to allow air flowing along a duct body 811 to be discharged from the first cabinet 1 therethrough.

In a case in which the laundry treating apparatus 100 according to the embodiment of the present invention is used only to dry laundry, the first receiving space may include a drum 2 rotatably disposed in the first cabinet 1.

The drum 2 may be formed in a cylindrical shape opened at the front and rear thereof. In this case, a front support unit 17 and a rear support unit 19 to rotatably support the drum 2 may be further provided in the first cabinet 1.

The front support unit 17 may include a support unit body 171 fixed in the first cabinet 1, a body through hole 173 formed through the support unit body 171, and a front flange 175 provided at the support unit body 171 to support the front of the drum 2.

The body through hole 173 is provided to communicate with the laundry introduction port 11. Consequently, laundry introduced through the laundry introduction port 11 may move into the drum 2 through the body through hole 173.

The body through hole 173 is provided with a hollow guide pipe 1731 extending toward the door 15. In this case, the guide pipe 1731 may be connected between the front panel and the support unit body 171 to surround the circumference of the body through hole 173 and the circumference of the laundry introduction port 11.

Meanwhile, in a case in which the door 15 is at an angle to the front panel of the first cabinet 1, the length of the guide pipe 1731 located at the lower part of the door 15 may be greater than that of the guide pipe 1731 located at the upper part of the door 15.

The front flange 175 may be provided along the circumference of the body through hole 173 such that the front flange 175 protrudes from the surface of the support unit body 171 toward the drum 2. The front inner circumference of the drum 2 is supported by the outer circumference of the front flange 175.

Furthermore, the front support unit 17 is further provided with a discharge unit connection hole 177, into which a discharge unit 8, which will be described hereinafter, is coupled. The discharge unit connection hole 177 is formed through the guide pipe 1731 such that the inside of the drum 2 communicates with the outside of the drum 2.

The rear support unit 19 may include a support unit body 191 fixed in the first cabinet 1 and a rear flange 193 provided at the support unit body 191 to rotatably support the rear of the drum 2.

In addition, the rear support unit 19 is further provided with a supply unit connection hole 195, into which a supply unit 7, which will be described hereinafter, is coupled. The supply unit connection hole 195 is formed through the support unit body 191 such that the inside of the drum 2 communicates with the outside of the drum 2.

On the other hand, in a case in which the laundry treating apparatus 100 according to the embodiment of the present invention is used to dry and wash laundry, the first receiving space may include a tub (not shown) provided in the first cabinet 1 to contain wash water and a drum 2 rotatably coupled in the tub.

In this case, the front support unit and the rear support unit may be omitted. In addition, the body through hole 173, the guide pipe 1731, and the discharge unit connection hole 177 may be provided at the front of the tub, which is formed in a cylindrical shape, and the supply unit connection hole 195 may be provided at the rear of the tub. The drum 2 may be rotatably supported in the tub by a rotary shaft extending through the rear of the tub. In addition, a plurality of through holes, through which the tub communicates with the drum, may be provided at the outer circumference of the drum 2.

Hereinafter, the laundry treating apparatus 100 according to the embodiment of the present invention that is capable of only drying laundry will be described for the convenience of description.

The drum 2 is rotated by a drive unit 3. The drive unit 3 may include a drum motor 31 provided at the first cabinet 1, a first rotary shaft 33 and a second rotary shaft 35 rotated by the drum motor 31, and a belt 37 connected between the circumference of the drum 2 and the first rotary shaft 33.

The second rotary shaft 35 is connected to an exhaust fan 83 through the duct body 811. In the laundry treating apparatus 100 according to the embodiment of the present invention, therefore, it is possible to simultaneously rotate the drum 2 and the exhaust fan 83 using one drum motor 31.

The second cabinet 5 is located below the first cabinet 1 to not only serve as a pedestal to support the first cabinet 1 but also dry laundry received in the second receiving space.

The second cabinet 5 is separated from the first cabinet 1 by a cabinet wall 4. In a case in which the first cabinet 1 is formed in a shape opened at the bottom thereof and the second cabinet 5 is formed in a shape opened at the top thereof, the cabinet wall 4 may not only define the bottom of the first cabinet 1 but also define the top of the second cabinet 5.

The second cabinet 5 may be formed in a hexahedral shape opened at the front thereof. The interior of the second cabinet 5 is divided into an upper space and a lower space by a partition wall 51.

The second receiving space is provided in a space below the partition wall 51 (a space defined between the partition wall 51 and the second cabinet 5). The second receiving space may include a drawer 6 that can be drawn from the second cabinet 4.

A space above the partition wall 51 (a space defined between the partition wall 51 and the cabinet wall 4) may include a machinery compartment M to receive devices necessary to dry laundry stored in the drawer 6.

The drawer 6 may include a drawer body 61 located at the space below the partition wall 51 to receive laundry and a drawer panel 63 located at the open front of the second cabinet 5 to draw the drawer body 61 from the second cabinet 5.

The drawer body 61 may be formed in a hexahedral shape opened at the top thereof to serve as a laundry receiving space 611. The drawer panel 63 may be provided with a handle 631 to draw the drawer body 61.

Meanwhile, as shown in FIG. 3, the laundry treating apparatus 100 according to the embodiment of the present invention further includes a discharge unit 8 to discharge air in the drum (first receiving space) 2 and the drawer (second receiving space) 6 out of the laundry treating apparatus 100 and a supply unit 7 to selectively supply air to the drum 2 and the drawer 6, the supplying unit 7 having an additional supply fan 75 to supply air into the drawer 6.

The discharge unit 8 may include an exhaust duct 81 and an exhaust fan 83 provided in the exhaust duct 81.

The exhaust duct 81 discharges air in the drum 2 out of the laundry treating apparatus 100. In addition, the exhaust duct 81 exhausts air discharged from the drum 2 out of the laundry treating apparatus 100 via the drawer body 61.

To this end, the exhaust duct 81 may include a duct body 811 (see FIG. 2) located in the first cabinet 1 such that the discharge unit connection hole 177 and the discharge port 13 are connected to each other through the duct body 811 and a first connection channel 813 and a second connection channel 815 extending through the cabinet wall 4 such that the duct body 811 communicates with the interior of the drawer body 61.

In this case, the exhaust fan 83 is provided in the duct body 811 such that the exhaust fan 83 is located between the discharge unit connection hole 177 and the first connection channel 813. The exhaust fan 83 is rotated by a second rotary shaft 35 (see FIG. 2) of the drum motor 31 extending through the duct body 811. During operation of the drum motor 31, therefore, air in the drum 2 may introduced into the duct body 811.

Meanwhile, as shown in FIG. 4, the partition wall 51 is provided with a first connection channel fixing hole 511, a second connection channel fixing hole 513, an exhaust channel fixing hole 515, and a supply channel fixing hole 517.

The first connection channel fixing hole 511, the second connection channel fixing hole 513, the exhaust channel fixing hole 515, and the supply channel fixing hole 517 are formed through the partition wall 51. Consequently, the internal space (laundry receiving space) 611 of the drawer body 61 communicates with the space above the partition wall 51 through the above fixing holes, which will hereinafter be described in detail.

When the first connection channel 813 and the second connection channel 815 are respectively fixed in the first connection channel fixing hole 511 and the second connection channel fixing hole 513 through the cabinet wall 4, therefore, the laundry receiving space 611 of the drawer body 61 communicates with the duct body 811.

Meanwhile, as shown in FIG. 5, the exhaust duct 81 may further include a first exhaust damper 817 provided to open any one selected from between the first connection channel 813 and the duct body 811 and a second exhaust damper 819 provided to open any one selected from between the second connection channel 815 and the duct body 811.

The first exhaust damper 817 and the second exhaust damper 819 are hinged to the duct body 811. The first exhaust damper 817 opens any one selected from between the first connection channel 813 and the duct body 811 according to a control signal of a controller (not shown). On the other hand, the second exhaust damper 819 opens any one selected from between the second connection channel 815 and the duct body 811 according to a control signal of the controller (not shown).

As shown in FIG. 6, the supply unit 7 includes supply ducts 711, 713, 715, and 718 provided in the first cabinet 1 to supply air (heated air or unheated air) to the drum (first receiving space) 2 and the drawer (second receiving space) 6 and a supply fan 75 provided in the partition wall 51 (machinery compartment M) to move air in the drawer 6 to the supply duct 71.

In a case in which the supply unit 7 is provided to supply heated air (hot air) to the drum 2 or the drawer 6, a heater 73 is further provided in the supply ducts 711, 713, 715, and 718.

That is, the supply ducts 711, 713, 715, and 718 include a heating channel 711, provided in the first cabinet 1, in which the heater 73 is fixed, an exhaust channel (drawer exhaust channel) 713 and a drawer supply channel (second supply channel) 715 connected between the heating channel 711 and the drawer 6, and a drum supply channel (first supply channel) 718 connected between the heating channel 711 and the drum 2.

The heating channel 711 may be provided as a duct having an open side 7111 and a first discharge port 7113 and a second discharge port 7115 to discharge air introduced through the open side 7111.

In this case, the drum supply channel 718 is connected between the first discharge port 7113 and the supply unit connection hole 195 to supply air having passed through the heating channel 711 to the drum 2.

In addition, the drawer exhaust channel 713 is formed through the cabinet wall 4 such that the exhaust channel fixing hole 515 and the open side 7111 are connected to each other through the drawer exhaust channel 713 and the drawer supply channel 715 is formed through the cabinet wall 4 such that the second discharge port 7115 and the supply channel fixing hole 517 are connected to each other through the drawer supply channel 715.

Consequently, air in the drawer 6 (air in the laundry receiving space 611) may be supplied to the heating channel 711 through the drawer exhaust channel 713 and air in the heating channel 711 may be supplied into the drawer 6 through the drawer supply channel 715.

Meanwhile, the drawer exhaust channel (exhaust channel) 713 may be provided with a suction port 7135, through which the inside of the heating channel 711 communicates with the outside of the heating channel 711. The supply duct 71 may be provided with a first supply damper 717 to open any one selected from between the suction port 7135 and the drawer exhaust channel 713 and a second supply damper 719 to open any one selected from between the first discharge port 7113 and the second discharge port 7115.

The first supply damper 717 is hinged to the drawer exhaust channel 713 to open any one selected from between the suction port 7135 and the drawer exhaust channel 713 according to a control signal of the controller (not shown).

Alternatively, the first supply damper 717 may be hinged to the heating channel 711 to open any one selected from between the open side 7111 and the drawer exhaust channel 713.

The second supply damper 719 is hinged to any one selected from between the heating channel 711 and the drawer supply channel (second supply channel) 715 to open any one selected from between the first discharge port 7113 and the second discharge port 7115 according to a control signal of the controller (not shown).

In this case, the controller (not shown) may control the second supply damper 719 to be rotated to a position at which the first discharge port 7113 and the second discharge port 7115 are simultaneously opened.

The supply fan 75 moves air in the drawer 6 to the heating channel 711. The supply fan 75 may include a blade 751 provided in the drawer exhaust channel 713 such that the blade 751 is located above the exhaust channel fixing hole 515 and a fan motor 753 provided in the machinery compartment M to rotate the blade 751.

In the laundry treating apparatus 100 according to the embodiment of the present invention, therefore, the controller (not shown) independently control the exhaust fan 83 and the supply fan 75. Consequently, it is possible to prevent the drum 2 from being rotated when air is supplied only to the drawer 6.

Hereinafter, operation of the laundry treating apparatus 100 with the above-stated construction according to the embodiment of the present invention will be described with reference to FIG. 7.

FIG. 7A shows a case in which hot air is supplied only to the drum (first receiving space) 2, FIG. 7B shows a case in which hot air is supplied simultaneously to the drum (first receiving space) 2 and the drawer (second receiving space) 6, and FIG. 7C shows a case in which hot air is supplied only to the drawer (second receiving space) 6.

In a case in which hot air is supplied only to the drum 2, the first exhaust damper 817 closes the first connection channel 813 according to a control signal of the controller (not shown) and the second exhaust damper 819 closes the second connection channel 815 according to a control signal of the controller (not shown).

In addition, the controller (not shown) controls the first supply damper 717 to open the suction port 7135 and to close the drawer exhaust channel (exhaust channel) 713. Furthermore, the controller (not shown) controls the second supply damper 719 to close the drawer supply channel (second supply channel) 715 and to open the drum supply channel 718 (to open the first discharge port 7113 and to close the second discharge port 7115).

In this state, the controller (not shown) controls the drum motor 31 to be driven such that the drum 2 and the exhaust fan 83 are rotated by the drum motor 31.

When the exhaust fan 83 is rotated by the drum motor 31, air in the drum 2 is discharged out of the first cabinet 1 through the duct body 811 with the result that atmospheric pressure in the drum 2 is lowered.

Since the atmospheric pressure in the drum 2 is lowered, air in the first cabinet 1 is supplied to the drum 2 through the suction port 7135, the heating channel 711, and the drum supply channel 718. When the heater 73 is driven while the air passes through the heating channel 711, hot air may be supplied to the drum 2.

The drum 2 is rotated by the belt 37 while the air is supplied to the drum 2. Consequently, laundry received in the drum 2 may easily exchange heat with the air.

Meanwhile, air is continuously supplied to the heater 73 through the outside air introduction port 12 provided at the first cabinet 1 and the suction port 7135 provided at the drawer exhaust channel 713.

In a case in which hot air is supplied simultaneously to the drum 2 and the drawer 6 as shown in FIG. 7B, the first exhaust damper 817 opens the first connection channel 813 according to a control signal of the controller (not shown) and the second exhaust damper 819 opens the second connection channel 815 according to a control signal of the controller (not shown).

In addition, the controller (not shown) controls the first supply damper 717 to open the suction port 7135 and to close the drawer exhaust channel (exhaust channel) 713. Furthermore, the controller (not shown) controls the second supply damper 719 to close the drawer supply channel 715 and to open the drum supply channel 718.

In this state, the controller (not shown) controls the drum motor 31 to be driven such that the drum 2 and the exhaust fan 83 are rotated by the drum motor 31.

When the exhaust fan 83 is rotated by the drum motor 31, air in the drum 2 is introduced into the duct body 811 and then supplied to the laundry receiving space 611 of the drawer 6 through the first connection channel 813 and air in the laundry receiving space 611 of the drawer 6 is discharged out of the first cabinet 1 through the second connection channel 815.

Since atmospheric pressure in the drum 2 is lowered as the air is discharged from the drum 2, air in the first cabinet 1 is supplied to the drum 2 through the suction port 7135, the heating channel 711, and the drum supply channel 718. When the heater 73 is driven while the air passes through the heating channel 711, hot air may be supplied to the drum 2 and the drawer 6.

In a case in which hot air is supplied only to the drawer 6 as shown in FIG. 7C, the first supply damper 717 closes the suction port 7135 and opens the drawer exhaust channel (exhaust channel) 713 according to a control signal of the controller (not shown).

In addition, the second supply damper 719 opens the drawer supply channel 715 and closes the drum supply channel 718 according to a control signal of the controller (not shown). At this time, the second exhaust damper 819 opens the second connection channel 815 according to a control signal of the controller (not shown).

The controller may control the first exhaust damper 817 to open the first connection channel 813. When the first connection channel 813 is opened, however, some of the air supplied into the laundry receiving space 611 of the drawer 6 may be moved into the drum and condense on the inner circumference of the drum 2. For this reason, the controller may control the first exhaust damper 817 to close the first connection channel 813.

In this state, the controller (not shown) controls the fan motor 753 to be rotated (in this case, the drum motor 31 is not rotated).

When the fan motor 753 is rotated, air in the laundry receiving space 611 of the drawer 6 moves to the heating channel 711 through the drawer exhaust channel 713 and the air having passed through the heating channel 711 is resupplied to the laundry receiving space 611 of the drawer 6 through the drawer supply channel (second supply channel) 715.

When the heater 73 is driven while the air passes through the heating channel 711, hot air may be supplied to the laundry receiving space 611 of the drawer 6. The air supplied into the laundry receiving space 611 of the drawer 6 is discharged out of the laundry treating apparatus 100 through the second connection channel 815 and the duct body 811.

Meanwhile, wall through holes 41 (see FIG. 6) may be provided at the cabinet wall 4 such that air is continuously supplied to the laundry receiving space 611 of the drawer 6.

Furthermore, in a structure in which the space above the partition wall 51 and the interior of the drawer 6 are hermetically sealed by the partition wall 51, partition wall through holes (not shown) may also be provided at the partition wall 51.

The reason that the laundry treating apparatus 100 according to the embodiment of the present invention further includes the supply fan 75 controlled independent of the exhaust fan 83 is that it is necessary to prevent rotation of the drum 2 when air is supplied only to the drawer 6.

That is, in the laundry treating apparatus 100 according to the embodiment of the present invention, the exhaust fan 83 and the respective dampers 717, 719, 817, and 819 may be controlled to supply air to laundry stored in the drawer 6 without the provision of the supply fan 75 (see FIG. 7B).

In a case in which laundry is stored only in the drawer 6, however, the drum 2 may be rotated and hot air may be supplied to the drum 2 although no laundry is received in the drum 2 if the supply fan 75 is not provided.

Furthermore, since the drum 2 is rotated although the laundry treating apparatus 100 is operated only to dry the laundry stored in the drawer 6, a user may think that the laundry treating apparatus 100 may malfunction.

The supply fan 75 included in the laundry treating apparatus 100 according to the embodiment of the present invention solves the above problem.

Meanwhile, in a case in which air is supplied simultaneously to the drum 2 and the drawer 6 (see FIG. 7B), humidity of air to be supplied to the drawer 6 is high because the air has already exchanged heat with the laundry stored in the drum 2.

When the humidity of air to be supplied to the drawer 6 is high, time necessary to dry the laundry stored in the drawer 6 may be increased. For this reason, the laundry treating apparatus 100 according to the embodiment of the present invention may further include a dehumidification unit 85 provided in the duct body 811 to dehumidify air.

As shown in FIG. 5(*b*), the dehumidification unit 85 may include a housing 851 provided in the duct body 811 such that the housing 851 is disposed between the discharge unit connection hole 177 and the first connection channel 813 and a dehumidifying agent (drying agent) 853 rotatably provided in the housing to dehumidify air introduced into the duct body 811.

The dehumidification unit 85 may further include a first through hole 8511 formed through the housing 851 such that the first through hole 8511 is located in the duct body 811 and a second through hole 8513 formed through the housing 851 such that the second through hole 8513 is located outside the duct body 811.

The dehumidifying agent 853 is rotatably fixed in the housing 851 through a rotary shaft 855. Air in the duct body 811 passes through the dehumidifying agent 853 through the first through hole 8511. Air in the first cabinet 1 comes into contact with the dehumidifying agent 853 through the second through hole 8513.

The dehumidifying agent 853 may be rotated in the housing 851 by a belt 857 connected between a rotary shaft of a motor 856 and the outer circumference of the dehumidifying agent 853 such that the dehumidifying agent 853 is reproduced by a heater 858 and a fan 859 to supply hot air to the second through hole 8513.

That is, the dehumidifying agent 853, which is located in the first through hole 8511 to absorb water from air flowing in the duct body 811, is moved to the second through hole 8513 by the motor 856 and the belt 857 and the water absorbed by the dehumidifying agent 853 is removed by the 858 and the fan 859 to supply hot air to the second through hole 8513.

Meanwhile, the second connection channel 815, through which air in the drawer 6 is easily withdrawn, included in the laundry treating apparatus 100 according to the embodiment of the present invention may be configured to have a form shown in FIG. 8. That is, the second connection channel 815 included in the laundry treating apparatus 100 according to the embodiment of the present invention may be configured such that the sectional area of the second connection channel 815 gradually increases from the duct body 811 toward the partition wall 51.

In addition, the laundry treating apparatus 100 according to the embodiment of the present invention may further include at least one diffusion unit 53 to diffuse air supplied to the drawer 6 through the drawer supply channel (second supply channel) 715 and the first connection channel 813 in the drawer 6.

The at least one diffusion unit 53 may be configured to have a form shown in FIG. 9 or 10.

The diffusion units 53 shown in FIG. 9 are fixed to the bottom of the partition wall 51 such that the diffusion units 53 are located below the first connection channel fixing hole 511 and the supply channel fixing hole 517.

In this embodiment, each diffusion unit 53 may include a diffusion plate 531 located below the partition wall 51 (below the first connection channel fixing hole 511 or the supply channel fixing hole 517) and a plurality of spacers 534 provided along the outer circumference of the diffusion plate 531 at predetermined intervals such that the diffusion plate 531 is spaced apart from the partition wall 51 by a predetermined distance.

Consequently, air introduced into the drawer 6 through the first connection channel fixing hole 511 or the supply channel fixing hole 517 collides with the diffusion plate 531 and is diffused into the laundry receiving space 611 of the drawer 6 through spaces defined between the respective spacers 534. As a result, the laundry received in the drawer 6 may be more easily dried.

In this embodiment, each diffusion unit 53 may further include at least one supply hole 532 formed through the diffusion plate 531.

The diffusion unit 53 shown in FIG. 10 is configured to have a structure in which air introduced into the drawer 6 through the first connection channel fixing hole 511 and the supply channel fixing hole 517 is uniformly diffused in the laundry receiving space 611 of the drawer 6 through one diffusion plate 531.

That is, in this embodiment, the diffusion unit 53 may include a diffusion plate 531 disposed below the partition wall 51, a spacer 534 to fix the diffusion plate 531 to the bottom of the partition wall 51, a connection channel connection pipe 533 formed through the diffusion plate 531 such that the connection channel connection pipe 533 is fitted in the second connection channel fixing hole 513, an exhaust channel connection pipe 535 formed through the diffusion plate 531 such that the exhaust channel connection pipe 535 is fitted in the exhaust channel fixing hole 515, and a plurality of supply holes 537 and 539 formed through the diffusion plate 531.

The diffusion plate 531 may have the same width as the partition wall 51 or a width sufficient to receive the respective fixing holes 511, 513, 515, and 517. The diffusion plate 531 fixed to the partition wall 51 is located (L) in the second cabinet 5 such that the diffusion plate 531 does not interfere with the drawer body 61.

In this case, the spacer 534 extends along the outer circumference of the diffusion plate 531 to surround the respective fixing holes 511, 513, 515, and 517 such that the diffusion plate 531 is spaced apart from the partition wall 51 by a predetermined distance.

The supply holes 537 and 539 may include a plurality of first supply holes 537 provided along the edge of the diffusion plate 531 and a plurality of second supply holes 539 arranged from the edge of the diffusion plate 531 toward the middle of the diffusion plate 531.

Consequently, air discharged from the drawer 6 through the second connection channel 815 or the drawer exhaust channel 713 is prevented from leaking to a space defined between the partition wall 51 and the diffusion plate 531 by the connection channel connection pipe 533 and the exhaust channel connection pipe 535.

In addition, air discharged from the first connection channel 813 and the drawer supply channel 715 collides with the diffusion plate 531 and is then introduced into the drawer 6 through the supply holes 537 and 539. In the laundry treating apparatus 100 according to the embodiment of the present invention, therefore, it is possible to more easily dry the laundry received in the drawer 6.

In order to easily achieve heat exchange between the air introduced into the drawer 6 and the laundry received in the drawer 6, the drawer body 61 may be further provided with at least one selected from between inclined parts 613 and a plurality of drawer through holes 615.

The inclined parts 613 may be provided at only opposite corners provided in the longitudinal direction of the drawer body 61. Alternatively, the inclined parts 613 may be provided at all corners.

Consequently, the air introduced into the drawer body 61 moves toward the middle of the drawer body 61, in which the laundry is placed, along the inclined parts 613 to exchange heat with the laundry.

The drawer through holes 615 are formed through the drawer body 61. Consequently, some of the air introduced into the laundry receiving space 611 of the drawer 6 may be discharged from the laundry receiving space 611 of the drawer 6 and move along a space defined between the drawer body 61 and the second cabinet 5. Since the air moving along a space defined between the drawer body 61 and the second cabinet 5 is reintroduced into the laundry receiving space 611 of the drawer 6 through the drawer through holes 615, it is possible to prevent reduction of drying efficiency even in a case in which the laundry accumulates only at a portion of the laundry receiving space 611 of the drawer 6.

The drawer through holes 615 may be provided over the entire region of the drawer body 61 or only at the side wall of the drawer body 61.

The laundry treating apparatus 100 according to the embodiment of the present invention may further include a rack 65 provided in the laundry receiving space 611 of the drawer 6 to prevent contact between the laundry and the bottom of the drawer body 61.

The rack 65 may be configured to have a folded type structure as shown in FIG. 11.

In this case, the rack 65 may include a plurality of rack bodies 651 located in the drawer body 61 to support laundry, a plurality of rack body connection shafts 655 to interconnect the respective rack bodies 651, and a plurality of body support parts (wheels) 657 provided at the respective rack body connection shafts 655 to space the rack bodies 651 from the bottom of the drawer body 61 by a predetermined distance.

The total length of the rack bodies 651 is greater than the length of the drawer body 61 and the rack body connection shafts 655 having no body support parts 657 (a coupling part between each rack body 651 and an adjacent rack body 651) protrude toward the partition wall 51. Consequently, the respective rack bodies 651 are inclined.

In this case, the first connection channel 813 may be further provided with a guider 8131 (see FIG. 5) to guide air to the front (one surface of the drawer body 61 located in a direction in which the drawer panel 63 is provided) or the rear of the drawer body 61.

Experiments reveal that, in a case in which air is supplied toward the front of the drawer body 61, the air moves along the inclined rack bodies 651, thereby improving drying efficiency of laundry.

Meanwhile, the rack 65 may further include a plurality of rack body through holes 653 formed through the rack bodies 651 such that air flows through the rack bodies 651.

In addition, the rack 65 may further include rack inclined parts 659 rotatably coupled to the rack bodies 651 via the rack body connection shafts 655.

The rack inclined parts 659 are inclined from the drawer body 61 toward the partition wall 51. In a case in which the inclined parts 613 provided at the drawer body 61 are located at only the opposite corners at which the inclined parts 613 faces each other (see FIG. 10), the rack inclined parts 659 may be located in a direction perpendicular to the inclined parts 613 (at the front corner and the rear corner of the drawer body 61).

On the other hand, as shown in FIG. 12, the rack 65 may include a rack body 651 provided in the drawer body 61, a body support part 657 to space the rack body 651 from the bottom of the drawer body 61 by a predetermined distance so as to improve drying efficiency, and rack inclined parts 659 provided at opposite ends of the rack body 651 such that the rack inclined parts 659 are inclined toward the partition wall 51.

In this embodiment, the rack body 651 may include a plurality of rack body through holes 653 divided by ribs 654. In this case, the body support part 657 may extend from the ribs 654 toward the bottom of the drawer body 61.

In addition, the body support part 657 may include a pair of plates spaced apart from each other by the width of each rib 654.

Furthermore, in this embodiment, the rack 65 may further include rib through holes 656 formed through the ribs 654 and support part through holes 658 formed through the body support part 657. The rib through holes 656 and the support part through holes 658 are provided to easily dry the laundry received in the drawer 6.

The rack body 651 may be provided with a protruding part 652 protruding toward the partition wall 51. The protruding part 652 may protrude toward any one selected from between the first connection channel fixing hole 511 and the supply channel fixing hole 517.

Air supplied into the drawer 6 through the first connection channel 813 or the drawer supply channel (second supply channel) 715 is guided by the protruding part 652 such that the air moves from the middle of the drawer body 61 to the edge of the drawer body 61, thereby improving drying efficiency.

Although FIG. 12 shows a case in which the rack body 615 is provided with only one protruding part 652, the protruding part 652 may include a protruding part protruding toward the first connection channel fixing hole 511 and a protruding part protruding toward the supply channel fixing hole 517 as shown in FIG. 1.

Meanwhile, as shown in FIG. 13, in the laundry treating apparatus 100 according to the embodiment of the present invention, an exhaust fan motor 39 to rotate the exhaust fan 83 may be provided independent of the drum motor 31 to rotate the drum 2 to prevent rotation of the drum 2 when the laundry stored in the drawer 6 is dried.

In this case, the drawer exhaust channel 713, the supply fan 7, and the exhaust channel fixing hole 515 as shown in FIG. 1 may be omitted.

Meanwhile, a drawer heater H may be further provided in the first connection channel 813. In addition, the duct body 811 may further provided with a duct body through hole 8111 and a third supply damper 8113 to open any one selected from between the duct body through hole 8111 and the duct body 811.

In a case in which air is supplied only to the drum 2, the drum motor 31 and the exhaust fan motor 39 are driven in a state in which the first exhaust damper 817, the second exhaust damper 819, and the second supply damper 719 close the first connection channel 813, the second connection channel 815, and the drawer supply channel (second supply channel) 715, respectively, and the third supply damper 8113 closes the duct body through hole 8111.

In a case in which hot air is supplied to the drum 2, the controller (not shown) controls the heater 73 provided in the heating channel 711 to be driven.

On the other hand, in a case in which air is supplied simultaneously to the drum 2 and the drawer 6, the drum motor 31 and the exhaust fan motor 39 are driven in a state in which the third supply damper 8113 and the second supply damper 719 close the duct body through hole 8111 and the drawer supply channel 715, respectively, and the first exhaust damper 817 and the second exhaust damper 819 open the first connection channel 813 and the second connection channel 815, respectively.

In a case in which hot air is supplied to the drum 2 and the drawer 6, the controller (not shown) may control the heater 73 provided in the heating channel 711 to be driven. Alternatively, the controller (not shown) may control the heater 73 provided in the heating channel 711 and the drawer heater H provided in the first connection channel 813 to be simultaneously driven.

In a case in which air is supplied only to the drawer 6, the third supply damper 8113 is controlled to open the duct body through hole 8111 and to close discharge unit connection hole 177, the second supply damper 719 is controlled to close the drum supply channel 718, and the first exhaust damper 817 and the second exhaust damper 819 are controlled to open the first connection channel 813 and the second connection channel 815, respectively.

When the exhaust fan motor 39 and the drawer heater H are driven in this state, air may be supplied into the drawer 6 through the duct body through hole 8111, the duct body 811, and the first connection channel 813. The air supplied into the drawer 6 may be discharged from the laundry treating apparatus through the second connection channel 815 and the duct body 811.

Meanwhile, the laundry treating apparatus according to the embodiment shown in FIG. 13 may exhibit characteristics to improve drying efficiency provided by the laundry treating apparatus according to the embodiment shown in FIG. 2. Structural characteristics to improve drying efficiency have been previously described and, therefore, a detailed description thereof will be omitted.

The first exhaust damper 817 and the second exhaust damper 819 included in the laundry treating apparatus according to the embodiment of the present invention may be configured to have forms as shown in FIG. 14.

That is, as shown in FIG. 14(*a*), the first exhaust damper 817 and the second exhaust damper 819 may each have an inclined free end.

In a case in which protruding parts, in which the first exhaust damper 817 and the second exhaust damper 819 are received, are formed along the outer circumferences of the first connection channel 813 and the second connection channel 815, lint may accumulated at the protruding parts.

In addition, even in a case in which sections of the respective exhaust dampers 817 and 819 are stepped and portions of the respective exhaust dampers 817 and 819 are inserted into the corresponding connection channels 813 and 815, the free ends of the respective exhaust dampers 817 and 819 remain protruding from the surface of the duct body 811 with the result that lint may accumulated at the free ends of the respective exhaust dampers 817 and 819.

The inclined surfaces provided at the free ends of the first exhaust damper 817 and the second exhaust damper 819 minimize accumulation of lint at the free ends of the first exhaust damper 817 and the second exhaust damper 819. Consequently, the inclined surfaces may be formed in a direction different from that shown in the drawing.

Meanwhile, at least one of the exhaust dampers 817 and 819 may be curved as shown in FIG. 14(*b*). In a case in which the first exhaust damper 817 and the second exhaust damper 819 are curved, it is possible to minimize air pressure loss which may be generated in a case in which the first exhaust damper 817 and the second exhaust damper 819 are flat as shown in FIG. 14(*a*). Consequently, air may easily supplied from the duct body 811 to the drawer (second receiving space) 6 and, in addition, may easily discharged from the drawer 6 to the duct body 811 (reduction of drying efficiency is prevented).

FIG. 15 is a view showing sealers 816 provided at the outer circumferences of the respective exhaust dampers 817 and 819. The sealers 816 may be provided to surround top edges and bottom edges of the respective exhaust dampers 817 and 819.

When the exhaust dampers 817 and 819 open the connection channels 813 and 815, respectively, the sealers 816 may seal between the duct body 811 and the respective exhaust dampers 817 and 819. On the other hand, when the exhaust dampers 817 and 819 close the connection channels 813 and 815, respectively, the sealers 816 may seal contact portions between the respective exhaust dampers 817 and 819 and the corresponding connection channels 813 and 815. Consequently, the sealers 816 prevent reduction of drying efficiency.

The sealers 816 may be formed of a silicon material. Each sealer 816 may include a flange 8161 protruding from at least one selected from between the top and the side thereof. This is because, in a case in which the flange 8161 protrudes from the surface of the sealer 816, it is possible to minimize accumulation of lint at the sealer 816 as compared with a case in which the flange 8161 is depressed in the sealer 816.

FIG. 16 is a view showing a damper drive unit 9 to control operation of the first exhaust damper 817 and the second exhaust damper 819.

The damper drive unit 9 may include a damper motor 91 to rotate the first exhaust damper 817 and a power transmission unit 92 to transmit rotational force of the damper motor 91 to the second exhaust damper 819.

The power transmission unit 92 may include a first bar fixed to a rotary shaft of the first exhaust damper 817 rotated by the damper motor 91, a second bar rotatably coupled to the first bar, and a third bar connected between the second bar and a rotary shaft of the second exhaust damper 819.

In this case, when the damper motor 91 is driven such that the first exhaust damper 817 opens the first connection channel 813, the second exhaust damper 819 opens the second connection channel 815 through the power transmission unit 92. Consequently, the laundry treating apparatus 100 according to the embodiment of the present invention has the effect of controlling opening and closing of the first connection channel 813 and the second connection channel 815 using one damper motor 91.

Unlike the drawing, the damper motor 91 may be provided to rotate the rotary shaft of the second exhaust damper 819.

FIG. 17 is a view showing a case in which the damper drive unit 9 includes only the damper motor 91. In this embodiment, the damper motor 91 is provided to rotate the first exhaust damper 817. In this case, the second exhaust damper 819 opens the second connection channel 815 using air discharged from the drawer (second receiving space) 6.

When the damper motor 91 is driven such that the first exhaust damper 817 opens the first connection channel 813, air introduced into the duct body 811 is supplied to the drawer 6. When the second exhaust damper 819 is opened due to pressure of the air supplied into the drawer 6, the air in the drawer 6 may be collected into the duct body 811 through the second connection channel 815.

In this embodiment, therefore, it is possible to simultaneously open and close the first connection channel 813 and the second connection channel 815 using one damper motor 91. Consequently, it is not necessary to provide damper motors at the respective exhaust dampers 817 and 819.

FIG. 18 is a view showing that the power transmission unit of the damper drive unit 9 includes a first gear 93 and a second gear 94.

The damper motor 91 is provided to rotate the rotary shaft of the second exhaust damper 819. The first gear (driving gear) 93 is fixed to the rotary shaft of the second exhaust damper 819 and the second gear (driven gear) 94 is fixed to the rotary shaft of the first exhaust damper 817.

In this embodiment, therefore, it is possible to control opening and closing of the first connection channel 813 and the second connection channel 815 using one damper motor 91.

As shown in FIG. 18(*b*), the second gear (driven gear) 94 may be provided with a first stopper 941.

If the rotary shaft of the first exhaust damper 817 moves in the longitudinal direction of the rotary shaft, it may be difficult to seal the first connection channel 813 or the duct body 811. The first stopper 941 prevents movement of the first exhaust damper 817 in the longitudinal direction of the rotary shaft during rotation of the second gear 94.

To this end, the first stopper 941 may be formed in the shape of a disc having a diameter greater than the maximum diameter of the second gear 94 to support the surface of the first gear driving gear 93. In this case, the first stopper 941 may be integrated with the second gear 94.

FIG. 19 is a view showing that an auxiliary damper 818 to prevent wet air discharged from the drum 2 from being introduced into the drawer 6 is provided in the first connection channel 813.

The embodiment shown in FIGS. 16 to 18 has a structure in which the first connection channel 813 and the second connection channel 815 are simultaneously opened or closed using the damper drive unit 9. Air supplied into the drawer 6 to dry the laundry stored in the drawer 6 is discharged through the second connection channel 815 and the duct body 811. When air is supplied to the drawer 6, therefore, air in the drum 2 may be introduced into the drawer 6 through the duct body 811 and the first connection channel 813.

When the air in the drum 2 is introduced into the drawer 6 through the first connection channel 813, time necessary to dry the laundry stored in the drawer 6 is increased (drying efficiency is reduced). Particularly, in a case in which air is supplied to the drawer 6 immediately after drying of the laundry is completed through the drum 2, wet air may be supplied to the drawer 6. As a result, much more time and energy may be required to dry the laundry stored in the drawer 6. The auxiliary damper 818 solves the above problem.

The auxiliary damper 818 is rotatably fixed in the first connection channel 813. The first connection channel 813 remains open unless air is supplied into the drawer 6 through the supply unit 6.

In a case in which air is supplied simultaneously to the drum 2 and the drawer 6 (see FIG. 7B), therefore, the auxiliary damper 818 opens the first connection channel 813. On the other hand, in a case in which air is supplied only to the drawer 6 (see FIG. 7C), the auxiliary damper 818 closes the first connection channel 813 due to air pressure in the drawer 6. Consequently, it is possible to prevent air in the drum 2 from being introduced into the drawer 6 through the first connection channel 813.

Meanwhile, a second stopper 8181 to restrict a rotational angle of the auxiliary damper 818 is provided in the first connection channel 813. The second stopper 8181 prevents the auxiliary damper 818 from not returning to a position to open the first connection channel 813 (see FIG. 18(*a*)) when the auxiliary damper 818 is rotated by a predetermined angle or more.

FIGS. 20 to 22 are views showing a sensor 95 to sense positions of the respective exhaust dampers 817 and 819 and a controller included in the laundry treating apparatus including the damper drive unit 9 shown in FIGS. 16 to 18.

The sensor 95 may include a micro sensor or a contact sensor. In this case, two push parts 923 and 925 to push the sensor 95 are provided at a rotary shaft 921 of the first exhaust damper 817 rotated by the damper motor 91.

Angles of the first push part 923 and the second push part 925 may be variously set to satisfy the following conditions. That is, when the first exhaust damper 817 closes the first connection channel 813, the first push part 923 pushes the sensor 95 such that the sensor 95 generates an ON signal. On the other hand, when the first exhaust damper 817 open the first connection channel 813, the second push part 925 pushes the sensor 95 such that the sensor 95 generates an ON signal.

In a case in which the first exhaust damper 817 does not close the first connection channel 813 or does not fully open the first connection channel 813 (in a state in which the first exhaust damper 817 is in contact with the duct body 811), therefore, the sensor 95 generates an OFF signal.

As shown in FIG. 21, the ON or OFF signal generated by the sensor 95 is detected by the controller. Meanwhile, the controller may receive a signal generated by the sensor 95 as the damper motor 91 is repeatedly driven and stopped to determine whether the exhaust dampers 817 and 819 are in normal states or in abnormal states (states in which opening and closing of the first connection channel 813 and the second connection channel 816 cannot be controlled).

Referring to FIG. 22, when the laundry treating apparatus 100 is powered on (S10), the controller determines whether the sensor 95 has generated an ON signal (S11).

When the sensor 95 does not transmit an ON signal but transmits an OFF signal to the controller, the controller determines that the exhaust dampers 817 and 819 are in states in which the respective exhaust dampers 817 and 819 do not fully close or open the corresponding connection channels 813 and 815 (abnormal states).

The abnormal states of the exhaust dampers 817 and 819 may occur when operation of the laundry treating apparatus 100 is abruptly interrupted due to power failure or when the respective exhaust dampers 817 and 819 cannot normally open and close the corresponding connection channels 813 and 815 due to foreign matter, such as lint, in the duct body 811.

Upon determining that the exhaust dampers 817 and 819 are in the abnormal states, the controller controls the exhaust dampers 817 and 819 to move to initial positions and determines whether the exhaust dampers 817 and 819 can be normally opened and closed. The initial position of each exhaust damper may be set to any one selected from between a position in which each exhaust damper fully opens a corresponding connection channel and a position in which each exhaust damper fully closes a corresponding connection channel. Hereinafter, a description will be given based on a case in which the states in which the respective exhaust dampers fully open the corresponding connection channels are set as the initial positions.

The controller controls the damper motor 91 to be operated such that the damper motor 91 is rotated in a direction in which the respective exhaust dampers open the corresponding connection channels (S12: damper motor open) and determines whether the sensor 95 has generated an ON signal (S13).

Upon determining that the sensor 95 has not generated the ON signal, which means that the respective exhaust dampers 817 and 819 do not fully open the corresponding connection channels 813 and 815, the controller notifies a user of the abnormal states of the exhaust dampers (states in which the respective exhaust dampers do not open the corresponding connection channels) through a display unit (S14).

On the other hand, when the sensor 95 transmits the ON signal to the controller according to the operation of the damper motor 91 (S12), the controller controls the damper motor 91 to be operated such that the damper motor 91 is rotated in a direction in which the respective exhaust dampers 817 and 819 close the corresponding connection channels 813 and 815 (S21: damper motor close).

At this time, the controller determines whether the sensor 95 has sequentially generated an ON signal, an OFF signal, and an ON signal. Upon sequentially receiving the ON signal, the OFF signal, and the ON signal, the controller determines that the exhaust dampers are in the normal states. On the other hand, Upon not sequentially receiving the ON signal, the OFF signal, and the ON signal, the controller determines that the exhaust dampers are in the abnormal states (states in which the respective exhaust dampers do not close the corresponding connection channels) and notifies the user of the abnormal states of the exhaust dampers (S23).

Meanwhile, in a case in which the sensor 95 transmits an ON signal to the controller when the laundry treating apparatus 100 is powered on (S10), the controller does not know whether the respective exhaust dampers are open or closed.

Consequently, the controller controls the damper motor 91 to be operated such that the damper motor 91 is rotated in a direction in which the respective exhaust dampers open the corresponding connection channels (S15: movement of the exhaust dampers to the initial positions, damper motor open) and determines whether the sensor 95 has transmitted an OFF signal and then an ON signal (S16).

A case in which the sensor 95 does not sequentially transmit an ON signal, an OFF signal, and an ON signal may include a case in which the sensor 95 transmits only an ON signal (the respective exhaust dampers open the corresponding connection channels) and a case in which the sensor 95 transmits only an OFF signal (the respective exhaust dampers cannot open the corresponding connection channels in a state in which the connection channels are closed).

In a case in which the sensor 95 has transmitted only an OFF signal, the controller may notify the user of the abnormal states in which the respective exhaust dampers cannot open the corresponding connection channels.

On the other hand, in a case in which the sensor 95 has transmitted only an ON signal, the controller controls the damper motor 91 to be operated such that the damper motor 91 is rotated in a direction in which the respective exhaust dampers close the corresponding connection channels (S17: damper motor close) and determines whether the sensor 95 has sequentially generated an OFF signal and an ON signal (S18). Upon sequentially receiving the OFF signal and the ON signal, the controller determines that the respective exhaust dampers are in the normal states (S20). Otherwise, the controller notifies the user of the abnormal states in which the respective exhaust dampers cannot close the corresponding connection channels through the display unit (S19).

On the other hand, in a case in which the sensor 95 has sequentially generated an ON signal, an OFF signal, and an ON signal (S16), the controller may know that the exhaust dampers are in the states in which the exhaust dampers can open the corresponding connection channels. Consequently, the controller controls damper motor 91 to be rotated in a direction in which the connection channels are closed to determine whether exhaust dampers can close the corresponding connection channels (S21: damper motor close).

Subsequently, when the sensor 95 has sequentially generated an OFF signal and an ON signal, the controller determines that the exhaust dampers are in the states in which the exhaust dampers can close the corresponding connection channels (S24). On the other hand, when the sensor 95 has not sequentially generated an OFF signal and an ON signal, the controller notifies the user of states in which the exhaust dampers cannot close the corresponding connection channels (S23).

In the laundry treating apparatus according to the embodiment of the present invention, therefore, it is possible to determine whether the exhaust dampers are in the normal states or in the abnormal states using one sensor and to notify the user of the abnormal states of the exhaust dampers.

As is apparent from the above description, the present invention provides a laundry treating apparatus that supplies air to a plurality of receiving spaces provided to dry laundry.

In addition, the present invention provides a laundry treating apparatus that is capable of simultaneously supply air to a plurality of receiving spaces in which laundry is received and selectively supplying air only to a specific one of the receiving spaces.

In addition, the present invention provides a laundry treating apparatus configured such that air blowing means to supply air to a plurality of receiving spaces are individually provided in the respective receiving spaces.

In addition, the present invention provides a laundry treating apparatus with high drying efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating apparatus comprising:

a first cabinet having a first receiving space to receive laundry;

a second cabinet having a second receiving space to receive laundry, the second cabinet being separated from the first cabinet;

a partition wall located at an upper part of the second receiving space to divide an interior of the second cabinet;

a discharge unit to discharge air from the first receiving space and air from the second receiving space; and a supply unit comprising a supply duct to selectively supply air to the first receiving space and the second receiving space and a supply fan provided adjacent to the partition wall such that the supply fan is located in the second cabinet to move air from the second receiving space to the supply duct, wherein the supply duct comprises:

a heating channel provided in the first cabinet, the heating channel having a heater to heat air and a first discharge port and a second discharge port to discharge the heated air;

a first supply channel connected between the first discharge port and the first receiving space;

a second supply channel to allow the second discharge port and the second receiving space to communicate with each other therethrough; and an exhaust channel connected between the second receiving space and the heating channel, the supply fan being provided in the exhaust channel.

2. The laundry treating apparatus according to claim 1, wherein the supply duct further comprises:

a suction port provided at the exhaust channel to introduce air from the first cabinet to the heating channel;

a first supply damper to selectively open and close the suction port and the exhaust channel; and a second supply damper to selectively open and close the first discharge port and the second discharge port.

3. The laundry treating apparatus according to claim 2, wherein the discharge unit comprises:

a duct body provided in the first cabinet to allow the first receiving space to communicate with an outside of the first cabinet therethrough;

a first connection channel connected between the duct body and the second receiving space to guide air from the duct body to the second receiving space; and a second connection channel connected between the duct body and the second receiving space to guide air from the second receiving space to the duct body.

4. The laundry treating apparatus according to claim 3, wherein the discharge unit further comprises:

a first exhaust damper to selectively open any one selected from between the first connection channel and the duct body; and a second exhaust damper to selectively open any one selected from between the second connection channel and the duct body.

5. The laundry treating apparatus according to claim 4, wherein the discharge unit further comprises an exhaust fan provided in the duct body such that the exhaust fan is located between the first receiving space and the first connection channel to move air from the first receiving space to the duct body.

6. The laundry treating apparatus according to claim 5, wherein the discharge unit further comprises a dehumidification unit located between the exhaust fan and the first connection channel to dehumidify air discharged from the first receiving space.

7. The laundry treating apparatus according to claim 5, wherein the partition wall comprises:

a first connection channel fixing hole to allow the first connection channel to communicate with the second receiving space therethrough;

a second connection channel fixing hole to allow the second connection channel to communicate with the second receiving space therethrough;

an exhaust channel fixing hole to allow the exhaust channel to communicate with the second receiving space therethrough; and a supply channel fixing hole to allow the second supply channel to communicate with the second receiving space therethrough.

8. The laundry treating apparatus according to claim 7, further comprising a diffusion unit provided below the partition wall to diffuse air introduced into the second receiving space through at least one selected from between the first connection channel and the second supply channel in the second receiving space.

9. The laundry treating apparatus according to claim 8, wherein the diffusion unit comprises:

a diffusion plate provided below the supply channel fixing hole; and a plurality of spacers provided along an outer circumference of the diffusion plate at intervals such that the diffusion plate is spaced apart from the supply channel fixing hole by a predetermined distance.

10. The laundry treating apparatus according to claim 8, wherein the diffusion unit comprises:

a diffusion plate provided below the first connection channel fixing hole; and a plurality of spacers provided along an outer circumference of the diffusion plate at intervals such that the diffusion plate is spaced apart from the first connection channel fixing hole by a predetermined distance.

11. The laundry treating apparatus according to claim 8, wherein the diffusion unit comprises:

a diffusion plate provided below the partition wall;

a spacer provided to surround the first connection channel fixing hole, the second connection channel fixing hole, the exhaust channel fixing hole, and the supply channel fixing hole such that the diffusion plate is spaced apart from the partition wall by a predetermined distance;

an exhaust channel connection pipe formed through the diffusion plate such that the exhaust channel connection pipe is connected to the exhaust channel fixing hole;

a connection channel connection pipe formed through the diffusion plate such that the connection channel connection pipe is connected to the second connection channel fixing hole; and a plurality of supply holes formed through the diffusion plate.

12. The laundry treating apparatus according to claim 7, wherein the second cabinet is provided below the first cabinet to support the first cabinet, wherein the second receiving space comprises a drawer configured to be drawn from the second cabinet, and wherein the drawer is provided with a rack to space laundry from a bottom of the drawer by a predetermined distance.

13. The laundry treating apparatus according to claim 12, wherein the rack comprises:

a rack body provided in the drawer;

a protruding part protruding from the rack body toward at least one selected from between the second connection channel fixing hole and the supply channel fixing hole;

a plurality of rack body through holes formed through the rack body; and a body support part provided at the rack body to space the rack body from a bottom of the drawer by a predetermined distance.

14. The laundry treating apparatus according to claim 4, further comprising a damper drive unit to rotate the first exhaust damper and the second exhaust damper such that the first connection channel and the second connection channel are simultaneously opened or closed.

15. The laundry treating apparatus according to claim 14, wherein the damper drive unit comprises:

a damper motor to rotate any one selected from between the first exhaust damper and the second exhaust damper; and a power transmission unit to transmit rotational force of the damper motor to the other selected from between the first exhaust damper and the second exhaust damper.

16. The laundry treating apparatus according to claim 15, wherein the power transmission unit comprises:

a first bar fixed to the first exhaust damper such that the first bar is rotated along with the first exhaust damper by the damper motor;

a second bar rotatably coupled to the first bar; and a third bar connected between the second bar and the second exhaust damper.

17. The laundry treating apparatus according to claim 15, wherein the power transmission unit comprises:

a first gear provided at any one selected from between the first exhaust damper and the second exhaust damper such that the first gear is rotated by the damper motor; and a second gear provided at the other selected from between the first exhaust damper and the second exhaust damper such that the second gear is coupled to the first gear.

18. The laundry treating apparatus according to claim 4, wherein the first exhaust damper is driven by the damper drive unit to open the first connection channel, and the second exhaust damper closes the second connection channel due to weight such that the second connection channel opens as pressure in the second receiving space increases.

19. The laundry treating apparatus according to claim 4, further comprising a sensor to sense positions of the first exhaust damper and the second exhaust damper.

* * * * *